US011085450B2

(12) United States Patent
Dahouk et al.

(10) Patent No.: US 11,085,450 B2
(45) Date of Patent: Aug. 10, 2021

(54) PUMP HAVING A HOUSING WITH INTERNAL AND EXTERNAL PLANAR SURFACES DEFINING A CAVITY WITH AN AXIAL FLUX MOTOR DRIVEN IMPELLER SECURED THEREIN

(71) Applicants: Regal Beloit America, Inc., Beloit, WI (US); Regal Beloit Australia Pty. Ltd., Rowville (AU)

(72) Inventors: Mohamad Khalil Dahouk, Fort Wayne, IN (US); Jason Jon Kreidler, Sheboygan, WI (US); Bruce Cole, Fort Wayne, IN (US); Norman Carl Golm, Jr., Fort Wayne, IN (US); Lester Benjamin Manz, Paulding, OH (US); Gregory Gross, Fort Wayne, IN (US); Michael Allen Marks, Fort Wayne, IN (US); John Sheldon Wagley, Winona Lake, IN (US); Yilcan Guzelgunler, Troy, IN (US); Greg Heins, Aspendale (AU); Matthew J. Turner, Rowville (AU)

(73) Assignees: REGAL BELOIT AMERICA, INC., Beloit, WI (US); REGAL BELOIT AUSTRALIA PTY. LTD., Rovwille (AU)

( * ) Notice: Subject to any disclaimer, the term of this patent is extended or adjusted under 35 U.S.C. 154(b) by 32 days.

(21) Appl. No.: 16/115,657

(22) Filed: Aug. 29, 2018

(65) Prior Publication Data

US 2019/0003479 A1 Jan. 3, 2019

Related U.S. Application Data

(63) Continuation-in-part of application No. 14/514,984, filed on Oct. 15, 2014, now Pat. No. 10,087,938.

(Continued)

(51) Int. Cl.

| | |
|---|---|
| ***F04D 13/08*** | (2006.01) |
| ***F04D 13/12*** | (2006.01) |
| ***F04D 13/06*** | (2006.01) |

(52) U.S. Cl.

CPC ..... *F04D 13/086* (2013.01); *F04D 13/0666* (2013.01); *F04D 13/12* (2013.01)

(58) Field of Classification Search

CPC ..... F04D 13/086; F04D 13/12; F04D 13/08

(Continued)

(56) References Cited

U.S. PATENT DOCUMENTS

| | | | |
|---|---|---|---|
| 1,978,986 | A | 10/1934 | Coberly |
| 2,030,986 | A | 2/1936 | Havill |

(Continued)

FOREIGN PATENT DOCUMENTS

| | | | |
|---|---|---|---|
| CN | 1652328 | A | 8/2005 |
| EP | 1101435 | B1 | 4/2009 |

(Continued)

*Primary Examiner* — Patrick Hamo
*Assistant Examiner* — Benjamin Doyle
(74) *Attorney, Agent, or Firm* — Armstrong Teasdale LLP

(57) ABSTRACT

A pump includes a housing including a first portion thereof defining opposed parallel spaced apart internal and exterior generally planar surfaces. The pump also includes a first impeller rotatably secured to the housing and positioned within the housing. The pump also includes a first axial flux motor connected to the first impeller and at least partially positioned within the housing. The first axial flux motor includes a first motor rotor fixedly secured to the first impeller. The first motor rotor has a generally planar surface thereof positioned adjacent to and parallel to the internal generally planar surface of the first portion of the housing. The first axial flux motor includes a first motor stator fixedly secured to the housing. The first motor stator has a generally planar surface thereof positioned adjacent to and parallel to (Continued)

the external generally planar surface of the first portion of the housing.

20 Claims, 24 Drawing Sheets

Related U.S. Application Data

(60) Provisional application No. 61/892,604, filed on Oct. 18, 2013.

(58) Field of Classification Search
USPC ..... 417/423.5
See application file for complete search history.

(56) References Cited

U.S. PATENT DOCUMENTS 2,055,481 A 9/1936 Coberly
2,246,276 A 6/1941 Davidson
2,860,266 A 11/1958 Schrader
2,970,249 A 1/1961 Mazur
3,426,224 A 2/1969 Esters
3,726,606 A 4/1973 Peters
3,868,198 A 2/1975 Purtell
4,031,421 A 6/1977 Geiger
4,087,204 A 5/1978 Niedermeyer
4,164,852 A 8/1979 Anzalone
4,177,021 A 12/1979 Niedermeyer
4,201,519 A 5/1980 Niedermeyer
4,222,711 A * 9/1980 Mayer ..... F04B 49/06 417/36
4,631,001 A 12/1986 Keech
4,703,956 A 11/1987 Keech
4,730,989 A 3/1988 Laing
4,749,894 A * 6/1988 Iwata ..... H01B 3/441 174/120 SR
5,234,319 A 8/1993 Wilder
5,596,236 A 1/1997 Lee
5,692,882 A 12/1997 Bozeman, Jr.
5,778,671 A 7/1998 Bloomquist
6,012,909 A * 1/2000 Sloteman ..... F04D 13/0666 415/58.2
6,454,010 B1 9/2002 Thomas
6,457,306 B1 * 10/2002 Abel ..... B64G 1/401 417/16
6,648,252 B2 11/2003 Strutz
6,682,312 B1 1/2004 Ward
6,736,605 B2 5/2004 Ohashi
7,034,422 B2 4/2006 Ramu
7,309,216 B1 12/2007 Spadola, Jr.
8,186,975 B2 5/2012 Kochan, Jr.
8,435,009 B2 5/2013 Moore
8,561,502 B2 10/2013 Schultz
8,689,759 B2 4/2014 Schultz
8,791,664 B2 7/2014 Krishnamoorthy
8,956,130 B2 2/2015 Buzit
9,404,500 B2 8/2016 Stiles, Jr.
9,638,193 B2 5/2017 Bishop
2001/0032587 A1 10/2001 Falck
2002/0079763 A1 6/2002 Fleshman
2003/0049134 A1 3/2003 Leighton
2003/0116323 A1 6/2003 Pettigrew
2004/0018104 A1 1/2004 Watkins
2004/0194387 A1 10/2004 Hom
2005/0103286 A1 5/2005 Ji
2006/0099090 A1 5/2006 Kramp et al.
2006/0175064 A1 8/2006 Yuratich
2006/0222529 A1 10/2006 Watson
2007/0134111 A1 6/2007 Eybergen
2007/0273225 A1 11/2007 Head
2007/0280841 A1 * 12/2007 LaRose ..... A61M 1/101 417/423.12
2008/0056911 A1 3/2008 Hanke
2008/0111434 A1 5/2008 Head
2008/0200750 A1 * 8/2008 James ..... A61M 1/1017 600/16
2008/0286134 A1 11/2008 Regalado
2009/0142207 A1 6/2009 Ring
2010/0155036 A1 6/2010 Andris
2010/0231155 A1 9/2010 Schmidt
2011/0150676 A1 * 6/2011 Buzit ..... F04D 9/008 417/410.1
2011/0273054 A1 11/2011 Johnston
2012/0010753 A1 1/2012 Schuster
2012/0017634 A1 1/2012 Dorman
2012/0082570 A1 4/2012 Schultz
2012/0148427 A1 6/2012 Irving
2012/0223603 A1 9/2012 Knapp
2012/0266595 A1 10/2012 Buschur
2013/0118705 A1 5/2013 Potter
2013/0270183 A1 10/2013 Snydmiller
2013/0270945 A1 10/2013 Ziegler
2013/0294928 A1 11/2013 Rosinski
2014/0010675 A1 1/2014 Kent
2014/0101844 A1 4/2014 Wawrla
2014/0145525 A1 5/2014 Dooley
2014/0191606 A1 7/2014 Gieras
2014/0205475 A1 7/2014 Dale
2014/0238511 A1 8/2014 Klicpera
2014/0265653 A1 9/2014 Heins
2014/0343733 A1 11/2014 Turner
2015/0037171 A1 2/2015 Orrego
2015/0110642 A1 4/2015 Dahouk
2015/0252808 A1 9/2015 Rosinski
2015/0303418 A1 10/2015 Tanaka
2016/0006481 A1 1/2016 Rendusara
2016/0065113 A1 3/2016 Gauthier

FOREIGN PATENT DOCUMENTS

JP 03595706 B2 12/2004
JP 2010255616 A 11/2010
JP 03174374 U 3/2012
JP 05274524 B2 8/2013
JP 05364043 B2 12/2013
WO 0139353 A1 5/2001
WO 2012057885 A1 5/2012
WO 2013026775 A1 2/2013

* cited by examiner

PUMP HAVING A HOUSING WITH INTERNAL AND EXTERNAL PLANAR SURFACES DEFINING A CAVITY WITH AN AXIAL FLUX MOTOR DRIVEN IMPELLER SECURED THEREIN

CROSS REFERENCE TO RELATED APPLICATION

This application is a non-provisional application and claims priority to both U.S. Utility patent application Ser. No. 14/514,984 filed Oct. 15, 2014 for "PUMP, ASSOCIATED ELECTRIC MACHINE AND ASSOCIATED METHOD" and published as US 2015/0110642A1 on Apr. 23, 2015 and to U.S. Provisional Patent Application 61/892,604 filed Oct. 18, 2013 for "SUMP PUMP, ASSOCIATED ELECTRIC MACHINE AND ASSOCIATED METHOD", both of which are hereby incorporated by reference in their entireties.

BACKGROUND OF THE INVENTION

The embodiments described herein relate generally to a sump pump, and more specifically, to an apparatus and method associated with a motor and pump for a sump pump.

Various types of electric machines are used to rotate a variety of devices such as pumps to generate fluid (such as water or other fluid) flow for a variety of applications. Such applications include fluid movement in subterranean application in consumer, commercial and industrial environments. One common fluid flow application is for use to in residential basement and crawl space sump pump applications. The sump pump is positioned in a cylindrical pit formed in the floor of the basement. Drainage tile is typically positioned around the inner and/or, outer periphery of the foundation of the dwelling and is connected to the pit so that the accumulated subterranean water is directed into the pit.

Typically, an induction motor is connected to an impeller pump to form a device, typically called a sump pump, to generate fluid flow and to urge the pit water through a conduit and out the home. Motors typically include a rotating member (usually called a rotor) and a stationary member (usually called a stator). Motors typically utilize an electrical input to generate a magnetic field or fields to cause the rotor to rotate. Typically, the rotor and/or stator have electrical windings that use the electrical input to generate the magnetic fields. The other of the stator or rotor may have permanent magnets rather than electrical windings to provide magnetic fields. A pump having impeller or impellers is coupled to the motor to generate the fluid flow. The impeller or impellers often extend from a shaft.

Such sump pumps are usually the sole device for the removal of subterranean water that accumulates outside and below the floor of the basement after a rainy period and in many locations that is usually present in these locations all year long. If the sump pump fails to operate, the water in the pit overflows onto the floor of the basement and may seep through the basement floor and walls into the basement. Such flooding of the basement may result in damage to the home, particularly if the basement is finished.

The sump pumps may fail causing flooding in the basement and, if the basement is finished, great damage. The motor may fail, the power may be interrupted, the pump may fail, the water conduits may be obstructed or disconnected, and the pump needs may exceed the capacity of the pump in extreme weather conditions.

The present invention is directed to alleviate at least some of these problems with the prior art.

BRIEF DESCRIPTION OF THE INVENTION

According to an aspect of the present invention, a sump pumping device for pumping a fluid is provided. The pumping device includes a pump adapted for pumping the fluid and a power housing connected to the pump. The pumping device further includes a first motor operably connected to the pump and adapted to provide energy to the pump. At least a portion of the first motor is positioned within the power housing. The pumping device further includes a second motor operably connected to the pump and adapted to provide energy to the pump. At least a portion of the second motor is positioned within the power housing.

According to another aspect of the present invention, a pumping device for pumping a fluid is provided. The pumping device includes a pump adapted for pumping the fluid and a first motor operably connected to the pump and adapted to provide energy to the pump. The pumping device also includes a second motor operably connected to the pump and adapted to provide energy to the pump.

According to yet another aspect of the present invention a propulsion system for a pump for removing fluid collected from the subterranean surface adjacent a building. The system includes a housing operably connectable to the pump and a first motor operably connected to the pump and adapted to provide energy to the pump. At least a portion of the first motor is positioned within the power housing. The system also includes a second motor operably connected to the pump and adapted to provide energy to the pump. At least a portion of the second motor is positioned within the power housing According to another aspect of the present invention, a system for removing fluid from subterranean surface of a building is provided. The system includes a pump adapted for pumping the fluid and a first motor operably connected to the pump and adapted to provide energy to the pump. The system also includes a second motor operably connected to the pump and adapted to provide energy to the pump.

According to another aspect of the present invention, a pumping device for pumping a fluid is provided. The device includes a pump adapted for pumping the fluid and a motor. The motor has a stator and a rotor rotatably connected to the stator. The rotor and the stator are adapted to generate flux generally in a direction parallel to a rotational axis of the motor. The motor is operably connected to the pump and is adapted to provide rotational mechanical energy to the pump.

According to another aspect of the present invention, a pumping device for pumping a fluid is provided. The device includes a pump adapted for pumping the fluid and an electronically commutated motor operably connected to the pump and adapted to provide energy to the pump. The device also includes a controller operably connected to the motor and adapted to provide signals to the motor.

According to another aspect of the present invention, a motor for use with a pump for removing fluid collected from the subterranean surface adjacent a building is provided. The motor includes a housing configured for connection to the pump. The motor also includes a stator connected to the housing and a rotor rotatably connected to the stator and operably connected to the pump. The motor is adapted to provide energy to the pump. The stator has electromagnetic coils. The motor also includes a controller operably connected to the motor and adapted to provide signals to the motor to provide electronic commutation to the electromagnetic coils.

According to another aspect of the present invention, a method for removing fluid from subterranean surface of a building is provided. The method includes the steps of providing a sump, providing a discharging conduit, providing a housing, providing a pump, providing a first motor, and providing a second motor. The method also includes the step of positioning the pump.

The method also includes the step of positioning the first motor and the second motor at least partially in the housing. The method also includes the step of positioning the housing at least partially in the sump and the step of connecting the pump to the discharging conduit. The method also includes the step of operably connecting the pump to the first motor and the step of operably connecting the pump to the second motor.

According to another aspect of the present invention a pump is provided. The pump includes a housing including a first portion thereof defining opposed parallel spaced apart internal and exterior generally planar surfaces. The pump also includes a first impeller rotatably secured to the housing and positioned within the housing. The pump also includes a first axial flux motor connected to the first impeller and at least partially positioned within the housing.

The first axial flux motor includes a first motor rotor fixedly secured to the first impeller. The first motor rotor has a generally planar surface thereof positioned adjacent to and parallel to the internal generally planar surface of the first portion of the housing. The first axial flux motor includes a first motor stator fixedly secured to the housing. The first motor stator has a generally planar surface thereof positioned adjacent to and parallel to the external generally planar surface of the first portion of the housing.

According to another aspect of the present invention, the pump may be configured such that the housing includes a second portion thereof defining opposed parallel spaced apart internal and exterior generally planar surfaces.

According to another aspect of the present invention, the pump may further include a second impeller rotatably secured to the housing and positioned within the housing.

According to another aspect of the present invention, the pump may further include a second axial flux motor operably connected to the second impeller. At least a portion of the second axial flux motor may be positioned within the housing, the second axial flux motor including;

According to another aspect of the present invention, the second axial flux motor may further include a second motor rotor fixedly secured to the second impeller. The second motor rotor may have a generally planar surface thereof positioned adjacent to and parallel to the internal generally planar surface of the second portion of the housing.

According to another aspect of the present invention, the pump may further include a second motor stator fixedly secured to the housing, the second motor stator having a generally planar surface thereof positioned adjacent to and parallel to the external generally planar surface of the second portion of the housing.

According to another aspect of the present invention, the pump may be configured such that the first axial flux motor has a rotational centerline and a traverse centerline normal to the rotational centerline; and According to another aspect of the present invention, the pump may be configured such that the second axial flux motor has a rotational centerline and a traverse centerline normal to the rotational centerline. The traverse centerline of the first axial flux motor and the traverse centerline of the second axial flux motor may be coincident.

According to another aspect of the present invention, the pump may be configured such that the first axial flux motor has a rotational centerline and a traverse centerline normal to the rotational centerline According to another aspect of the present invention, the pump may be configured such that the second axial flux motor has a rotational centerline and a traverse centerline normal to the rotational centerline. The rotational centerline of the first axial flux motor and the rotational centerline of the second axial flux motor may be coincident.

According to another aspect of the present invention, the pump may be configured such that the housing defines a first cavity portion within the cavity for receiving the first motor impeller. The housing may define a first cavity fluid inlet port and a first cavity fluid outlet port.

According to another aspect of the present invention, the pump may be configured such that the housing defines a second cavity portion within the cavity for receiving the second motor impeller. The housing may define a second cavity fluid inlet port and a second cavity fluid outlet port.

According to another aspect of the present invention, the pump may further include a first check valve secured to the first cavity fluid outlet port for permitting the flow of fluid from the first cavity portion and for prohibiting the flow of fluid into the first cavity portion.

According to another aspect of the present invention, the pump may further include a second check valve secured to the second cavity fluid outlet port for permitting the flow of fluid from the second cavity portion and for prohibiting the flow of fluid into the second cavity portion.

According to another aspect of the present invention, the pump may be configured such that the first motor stator is encapsulated in a polymer.

According to another aspect of the present invention, the pump may be configured such that the first axial flux motor is an ECM motor.

According to another aspect of the present invention, the pump may be configured such that first motor rotor includes a shaft for supporting the rotor and such that the shaft is entirely contained within the housing.

According to another aspect of the present invention, the pump may further include a controller for controlling the rotational speed of the first axial flux motor.

According to another aspect of the present invention, a pump for removing fluid collected from the subterranean surface adjacent a building may be provided. The pump may include a housing defining a cavity therein and a first motor impeller rotatably secured to the housing and positioned within the cavity. The pump may further include a first axial flux motor having a rotational centerline and a traverse centerline normal to the rotational centerline. The first axial flux motor may be connected to the first motor impeller and at least partially positioned within the housing.

According to another aspect of the present invention, the first axial flux motor may include a first motor rotor fixedly secured to the first motor impeller and a first motor stator fixedly secured to the housing.

According to another aspect of the present invention, the pump may include a second motor impeller rotatably secured to the housing and positioned within the cavity and a second axial flux motor.

According to another aspect of the present invention, the second axial flux motor may include a having a rotational centerline and a traverse centerline normal to the rotational centerline. The second axial flux motor may be connected to the second motor impeller and at least partially positioned within the housing. The traverse centerline of the first axial flux motor and the traverse centerline of the second axial flux motor may be coincident According to another aspect of the present invention, the second axial flux motor ma further include a second motor rotor fixedly secured to the second motor impeller and a second motor stator fixedly secured to the housing.

According to another aspect of the present invention, the pump may be configured such that the housing defines a first cavity portion within the cavity for receiving the first motor impeller. The housing may define a first cavity fluid inlet port and a first cavity fluid outlet port.

According to another aspect of the present invention, the pump may be configured such that the housing defines a second cavity portion within the cavity for receiving the second motor impeller. The housing may define a second cavity fluid inlet port and a second cavity fluid outlet port.

According to another aspect of the present invention, the pump may further include a first check valve secured to the first cavity fluid outlet port for permitting the flow of fluid from the first cavity portion and for prohibiting the flow of fluid into the first cavity portion.

According to another aspect of the present invention, the pump may further include a second check valve secured to the second cavity fluid outlet port for permitting the flow of fluid from the second cavity portion and for prohibiting the flow of fluid into the second cavity portion.

According to another aspect of the present invention, the pump may be configured such that the housing includes a first portion thereof defining opposed parallel spaced apart internal and exterior generally planar surfaces.

According to another aspect of the present invention, the pump may be configured such that the first rotor has a generally planar surface thereof positioned adjacent to and parallel to the internal generally planar surface of the first portion of the housing.

According to another aspect of the present invention, the pump may be configured such that the first stator has a generally planar surface thereof positioned on the external generally planar surface of the first portion of the housing.

According to another aspect of the present invention, the pump may be configured such that the housing includes a second portion thereof defining opposed parallel spaced apart internal and exterior generally planar surfaces.

According to another aspect of the present invention, the pump may be configured such that the second rotor has a generally planar surface thereof positioned adjacent to and parallel to the internal generally planar surface of the second portion of the housing.

According to another aspect of the present invention, the pump may be configured such that the second stator has a generally planar surface thereof positioned on the external generally planar surface of the second portion of the housing.

According to another aspect of the present invention, the pump may be configured such that the first motor stator is encapsulated in oil.

According to another aspect of the present invention, the pump may be configured such that the first motor stator is encapsulated in a polymer.

According to another aspect of the present invention, the pump may be configured such that the first motor stator is water cooled.

According to another aspect of the present invention, the pump may be configured such that the first impeller is supported by water bearings.

According to another aspect of the present invention, the pump may be configured such that the housing defines a first cavity portion within the cavity for receiving the first motor impeller. The housing may define a first cavity fluid inlet port and a first cavity fluid outlet port.

According to another aspect of the present invention, the pump may be configured such that housing defines a second cavity portion within the housing cavity for receiving the second motor impeller. The housing may define a second cavity fluid inlet port and a second cavity fluid outlet port.

According to another aspect of the present invention, the pump may be configured such that the first cavity fluid inlet port is concentric with the rotational centerline of the first axial flux motor.

According to another aspect of the present invention, the pump may be configured such that second cavity fluid inlet port is concentric with the rotational centerline of the second axial flux motor.

According to another aspect of the present invention, the pump may be configured such that the housing defines a first cavity portion within the cavity for receiving the first motor impeller. The housing may define a first cavity fluid inlet port and a first cavity fluid outlet port.

According to another aspect of the present invention, the pump may be configured such that the housing defines a second cavity portion within the cavity for receiving the second motor impeller. The housing may define a second cavity fluid inlet port and a second cavity fluid outlet port.

According to another aspect of the present invention, the pump may be configured such that the housing defines a housing outlet port. The housing outlet port may be eccentric with the first cavity fluid inlet port and with the second cavity fluid inlet port.

According to another aspect of the present invention, a pump for removing fluid collected from the subterranean surface adjacent a building is provided. The pump may include a housing defining a cavity therein and a first motor impeller rotatably secured to the housing and positioned within the cavity.

According to another aspect of the present invention, the pump may further include a first axial flux motor having a rotational centerline and a traverse centerline normal to the rotational centerline. The first axial flux motor may be connected to the first motor impeller and at least partially positioned within the housing.

According to another aspect of the present invention, the pump may be configured such that the first axial flux motor includes a first motor rotor fixedly secured to the first motor impeller and a first motor stator fixedly secured to the housing.

According to another aspect of the present invention, the pump may further include a second motor impeller rotatably secured to the housing and positioned within the cavity and a second axial flux motor having a rotational centerline and a traverse centerline normal to the rotational centerline.

According to another aspect of the present invention, the pump may be configured such that the second axial flux motor is connected to the second motor impeller and at least partially positioned within the housing. The rotational centerline of the first axial flux motor and the rotational centerline of the second axial flux motor may be being coincident.

According to another aspect of the present invention, the second axial flux motor may include a second motor rotor fixedly secured to the second motor impeller and a second motor stator fixedly secured to the housing.

According to another aspect of the present invention, the pump may be configured such that the housing defines a first cavity portion within the cavity for receiving the first motor impeller. The housing may define a first cavity fluid inlet port and a first cavity fluid outlet port According to another aspect of the present invention, the pump may be configured such that the housing defines a second cavity portion within the cavity for receiving the second motor impeller. The housing may define a second cavity fluid inlet port and a second cavity fluid outlet port.

According to another aspect of the present invention, the pump may further include a first check valve secured to the first cavity fluid outlet port for permitting the flow of fluid from the first cavity portion and for prohibiting the flow of fluid into the first cavity portion a second check valve secured to the second cavity fluid outlet port for permitting the flow of fluid from the second cavity portion and for prohibiting the flow of fluid into the second cavity portion.

According to another aspect of the present invention, the pump may be configured such that the housing includes a first portion thereof defining opposed parallel spaced apart internal and exterior generally planar surfaces.

According to another aspect of the present invention, the pump may be configured such that the first rotor has a generally planar surface thereof positioned adjacent to and parallel to the internal generally planar surface of the first portion of the housing and wherein the first stator has a generally planar surface thereof positioned on the external generally planar surface of the first portion of the housing.

According to another aspect of the present invention a compressor is provided. The compressor includes a housing including a first portion thereof defining opposed parallel spaced apart internal and exterior generally planar surfaces. The pump also includes a first scroll rotatably secured to the housing and positioned within the housing. The pump also includes a first axial flux motor connected to the first scroll and at least partially positioned within the housing.

The first axial flux motor includes a first motor rotor fixedly secured to the first scroll. The first motor rotor has a generally planar surface thereof positioned adjacent to and parallel to the internal generally planar surface of the first portion of the housing. The first axial flux motor includes a first motor stator fixedly secured to the housing. The first motor stator has a generally planar surface thereof positioned adjacent to and parallel to the external generally planar surface of the first portion of the housing.

DETAILED DESCRIPTION OF THE INVENTION

Figure 1:
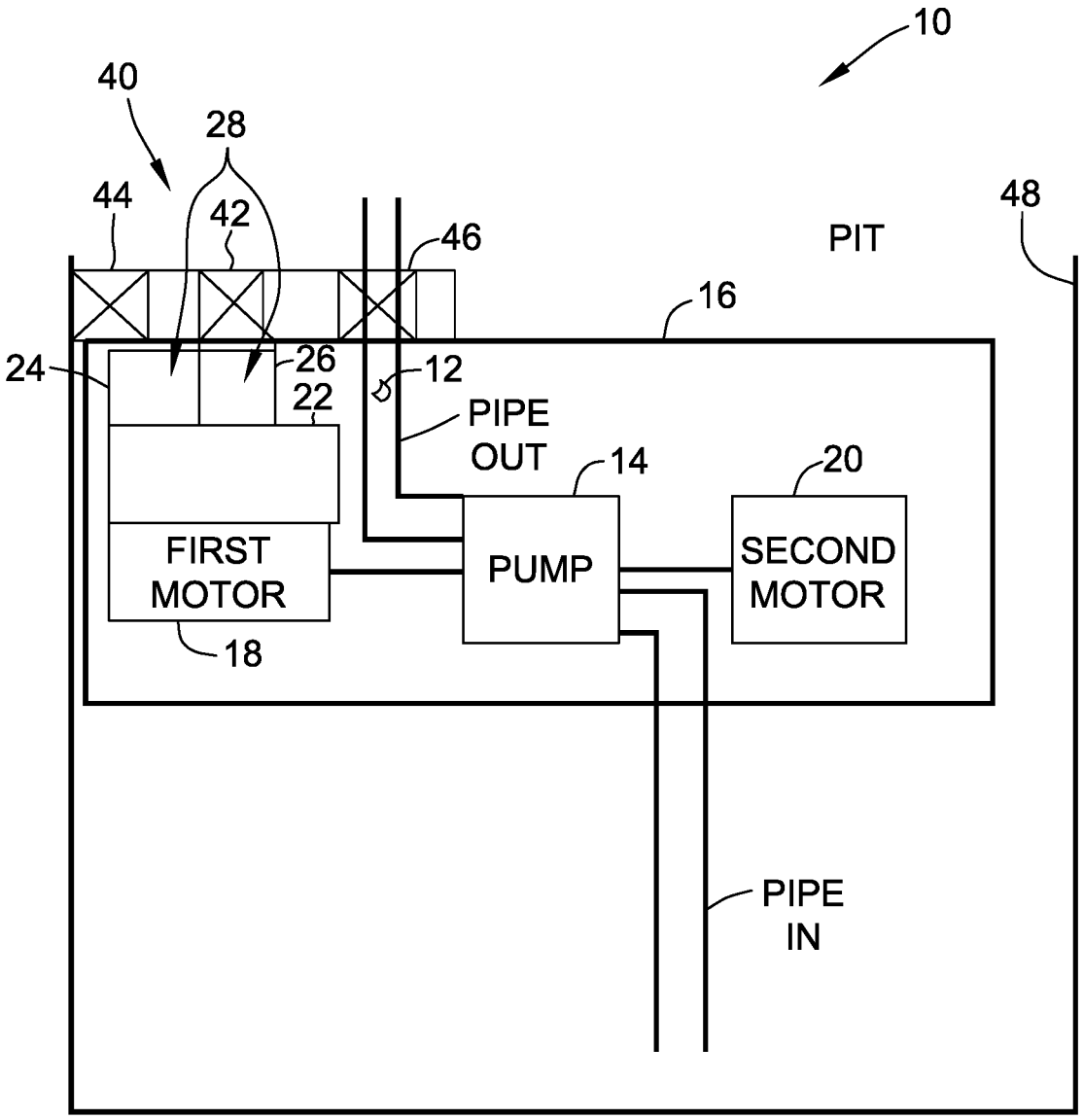
FIG. 1 is a plan view of an embodiment of the present invention in the form of a pumping device including a pump and two motors in a common housing.

Due to increased customer and industry demands, reduced noise and vibration, lower costs, and improved performance in capacity and efficiency are desirable in the design and manufacture of fluid moving devices powered by electric motors. The methods, systems, and apparatus described herein facilitate reduced noise and vibration, lower costs, and improved performance in capacity and efficiency for an electric machine. This disclosure provides designs and methods to reduce noise and vibration, lower costs, and improved performance in capacity and efficiency. This disclosure further provides designs and methods to reduce reduced noise and vibration, lower costs, and improved performance in capacity and efficiency Technical effects of the methods, systems, and apparatus described herein include at least one of improved performance and quality and reduced labor costs.

According to an aspect of the present invention a sump pumping device 10 for pumping a fluid 12 is provided. The pumping device 12 includes a pump 14 adapted for pumping the fluid 12 and a power housing 16 connected to the pump 14. The pumping device 10 further includes a first motor 18 operably connected to the pump 14 and adapted to provide energy to the pump 14. At least a portion of the first motor 18 is positioned within the power housing 16. The pumping device 10 further includes a second motor 20 operably connected to the pump 14 and adapted to provide energy to the pump 14. At least a portion of the second motor 20 is positioned within the power housing 16.

It should be appreciated that the pump 14 may be positioned adjacent to and connected to the first motors 18 and/or second motor 20. It should be appreciated that the first motors 18 and/or second motor 20 as well as the pump 14 may be at least partially enclosed within the power housing 16. For example, the housing 16 may enclose both the motors 18 and/or 20 and the pump 14. Such a configuration may provide a more compact configuration that may more easily be fitted into the pit and may be more easily and quickly installed into the pit.

As shown in FIG. 1, the first motor and/or the second motor may be adapted to be operably connectable to a power source 22. The power source 22 may, for example, be an alternating current (AC) power source, a direct current (DC) power source, a water source, such as races, dams or tides, a water pressure source, a water reservoir, batteries of various voltage, a DC solar power source, a DC wind turbine power source, a AC wind turbine power source, a DC wind turbine power source, a AC wind turbine power source, or an AC power source. It should be appreciated that the first motor 18 and/or the second motor 20 may be adapted to be connected to any combination of the above power sources listed or to any other available power source.

It should be appreciated that the first motor 18 or the second motor 20 may be an induction motor, a permanent magnet motor, a switched reluctance motor, an electronically commutated motor (ECM) motor or an axial flux motor. It should be appreciated that the motors 18 and 20 may be motors of the same or of different types.

An electronically commutated motor hereinafter referred to as an ECM motor may be a brushless alternating current motor or a brushless direct current motor. An ECM motor may include a trapezoidal drive or a sinusoidal drive.

The axial flux motor may have a controller. The controller may be an electronic controller. The controller may be used to commutate the motor.

The switched reluctance motor may have a controller. The controller may be an electronic controller. The controller may be used to commutate the motor, As shown in FIG. 1, the sump pumping device 10 may include a battery 24. The sump pumping device may include a charging device 26 for charging the battery 24. It should further be appreciated that the charging may be de-sulfating charging, trickle charging, fast charging or deep cycle charging, or a combination of such charging.

As shown in FIG. 1, the sump pumping device 10 may be provided with an isolator 28 for isolating the device from power spikes and lightning strikes. As shown in FIG. 1, the isolator 28 may be a back-up power system or battery system 28 including the battery 24 and the charging device 26.

As shown in FIG. 1, the battery system 28 may be positioned in compartment 30 of housing 16.

As shown in FIG. 1, the sump pumping device 10 may be provided with a quick change or quick coupling system 40 such that the sump pumping device 10 is adapted for quick change. While the pump 14, the first motor 18 and the second motor 20 may each include a quick coupling (not shown) for quick change of these components, as shown, the entire sump pumping device 10 may be provided with quick coupling system 40 to quickly change the entire sump pumping device 10. For example and as shown, the quick coupling system 40 may include a quick power coupling 42, a quick mounting coupling 44 and a quick plumbing coupling 46. The couplings 42, 44 and 46 may be arranged such that the entire sump pumping device 10 is connected as it is lowered in position in pit 48.

Figure 2:
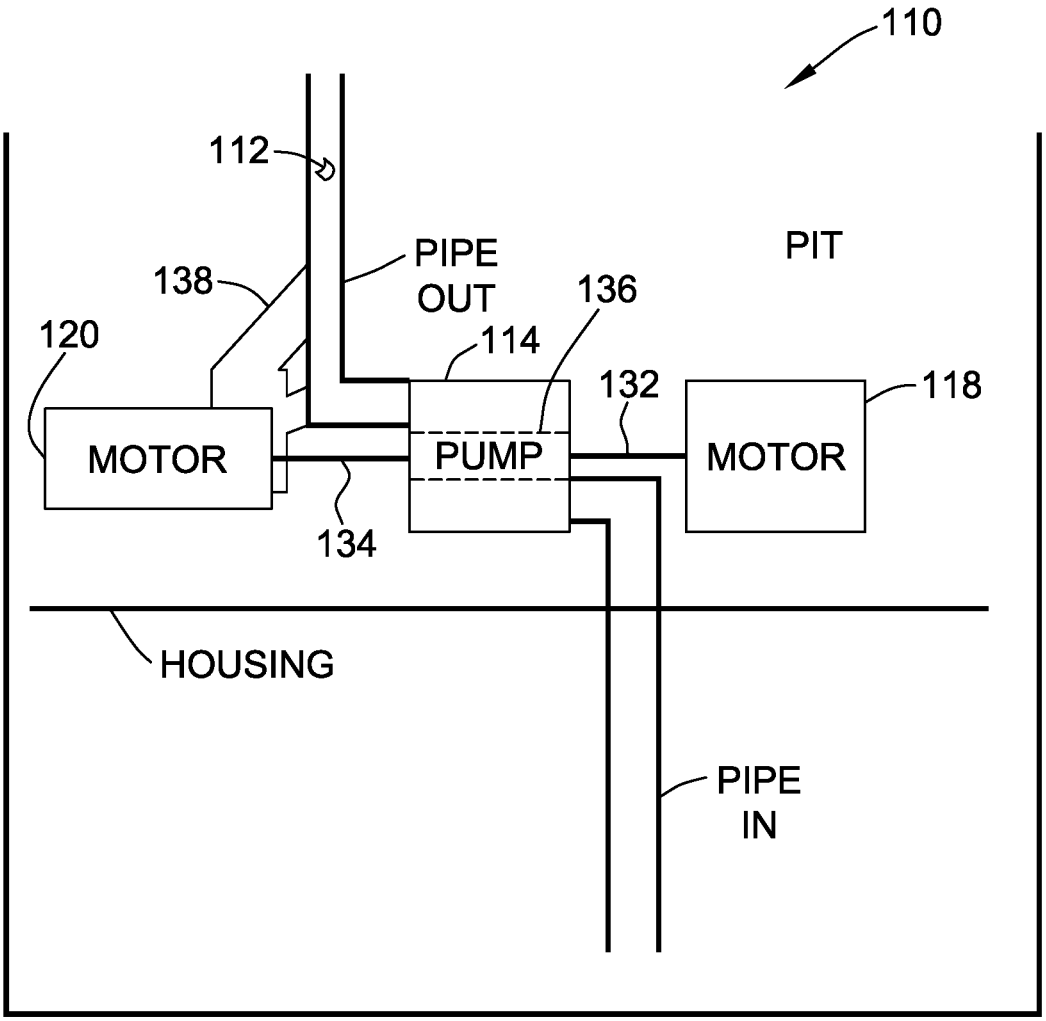
FIG. 2 is a plan view of an embodiment of the present invention in the form of a pumping device including pump driven by two motors.

Referring now to FIG. 2, another aspect of the present invention is shown as pumping device 110 for pumping a fluid 112 is shown. The pumping device 110 includes a pump 114 adapted for pumping the fluid 112 and a first motor 118 operably connected to the pump 114 and adapted to provide energy to the pump 114. The pumping device 110 also includes a second motor 120 operably connected to the pump 114 and adapted to provide energy to the pump 114.

For example and as shown in FIG. 2, the first motor 118 may be connected to the pump 114 by first shaft 132. Similarly, the second motor 120 may be connected to the pump 114 by second shaft 134. As shown, the first shaft 132 and the second shaft 134 may, as shown be collinear and be operably connected to pump shaft 136. Clutches and other mechanical mechanisms (not shown), as well as idling of the motor not in use, may be used to permit one of the motors 118 and 120 to be actively driving the pump 114 while the other motor is not in use, but ready to be used as a backup motor.

As shown in FIG. 2, sump pumping device 110 may be provided such that the first motor 118 and/or the second motor 120 is water cooled. It should be appreciated that the water-cooled motor may be cooled by the fluid being pumped. It should be appreciated that the water-cooled motor, shown as first motor 118, may include a water jacket, 138 surrounding at least a portion of the water-cooled motor 118. It should be appreciated that the sump pumping device 110 may be a submersible or a semi-submersible pump.

It should be appreciated that the pump 114 may be positioned adjacent to and connected to the first motors 118 and/or second motor 120. It should be appreciated that the first motors 118 and/or second motor 120 as well as the pump 114 may be at least partially enclosed within a housing. For example, the housing may enclose both the motors 118 and/or 120 and the pump 114. Such a configuration may provide a more compact configuration that may more easily be fitted into the pit and may be more easily and quickly installed into the pit.

Figure 3:
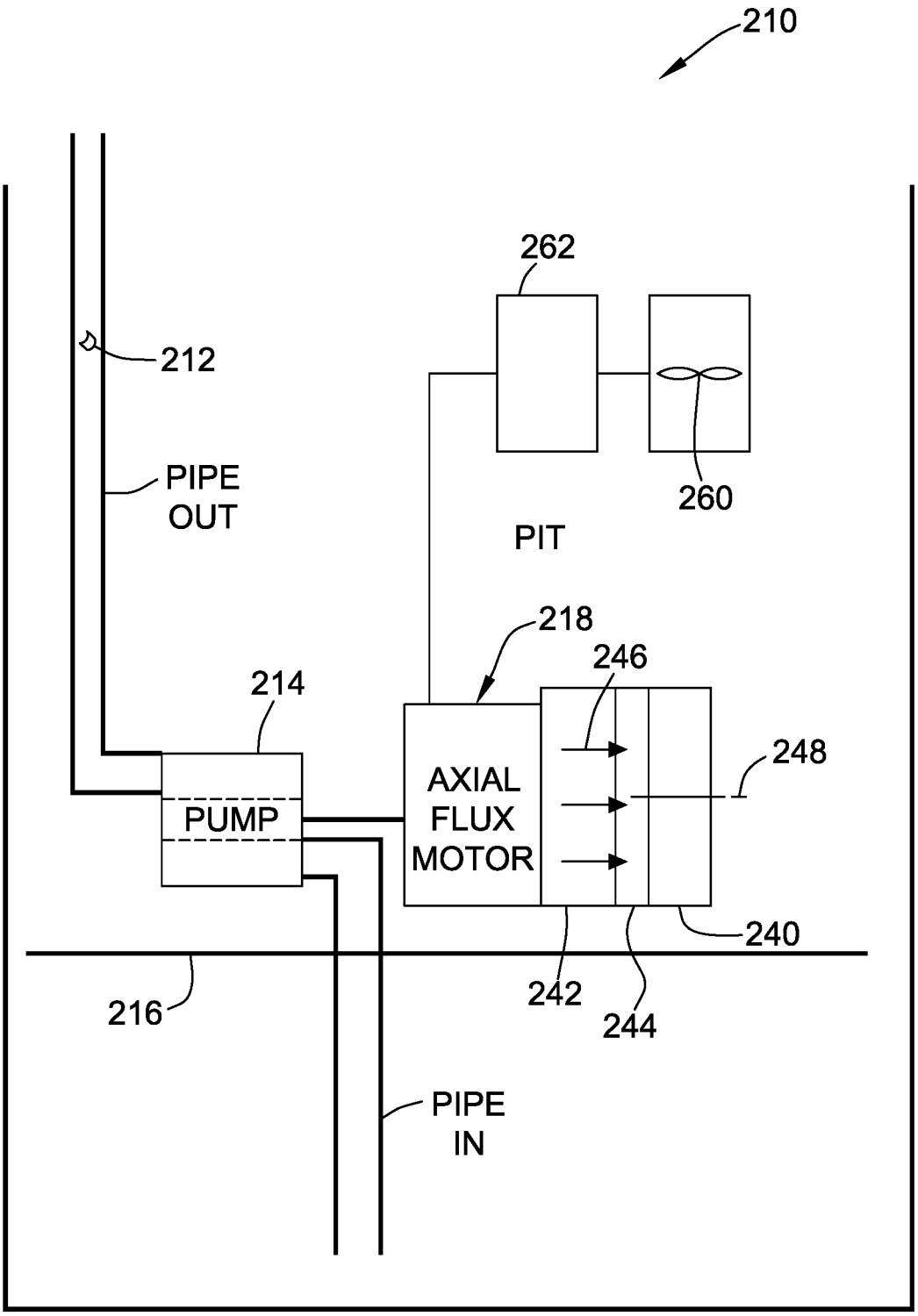
FIG. 3 is a plan view of an embodiment of the present invention in the form of a pumping device including an axial flux motor and a pump.

Referring now to FIG. 3, another aspect of the present invention is shown as pumping device 210 for pumping a fluid 212. The device 210 includes a pump 214 adapted for pumping the fluid 212 and a motor 218. The motor 218 has a stator 240 and a rotor 242 rotatably connected to the stator 240, by, for example, bearings 244. The rotor 242 and the stator 240 are adapted to generate flux 246 generally in a direction parallel to a rotational axis 248 of the motor 218. The motor 218 is operably connected to the pump 214 and is adapted to provide rotational mechanical energy to the pump 214. The pumping device 210 may include a power housing 216. A portion or all the motor 218 may be positioned within the power housing 216. Further all or a portion of the pump 214 may be positioned within the power housing 216.

According to another aspect of the present invention the sump pumping device 210 may include a turbine 260. It should further be appreciated that the turbine 260 may be adapted to be positioned in a downspout, a pressurized water line, or a conduit connected to a water reservoir. It should further be appreciated that the turbine 260 may be connected to a generator 262. It should further be appreciated that the generator 262 may be connected to the motor 218.

Figure 4:
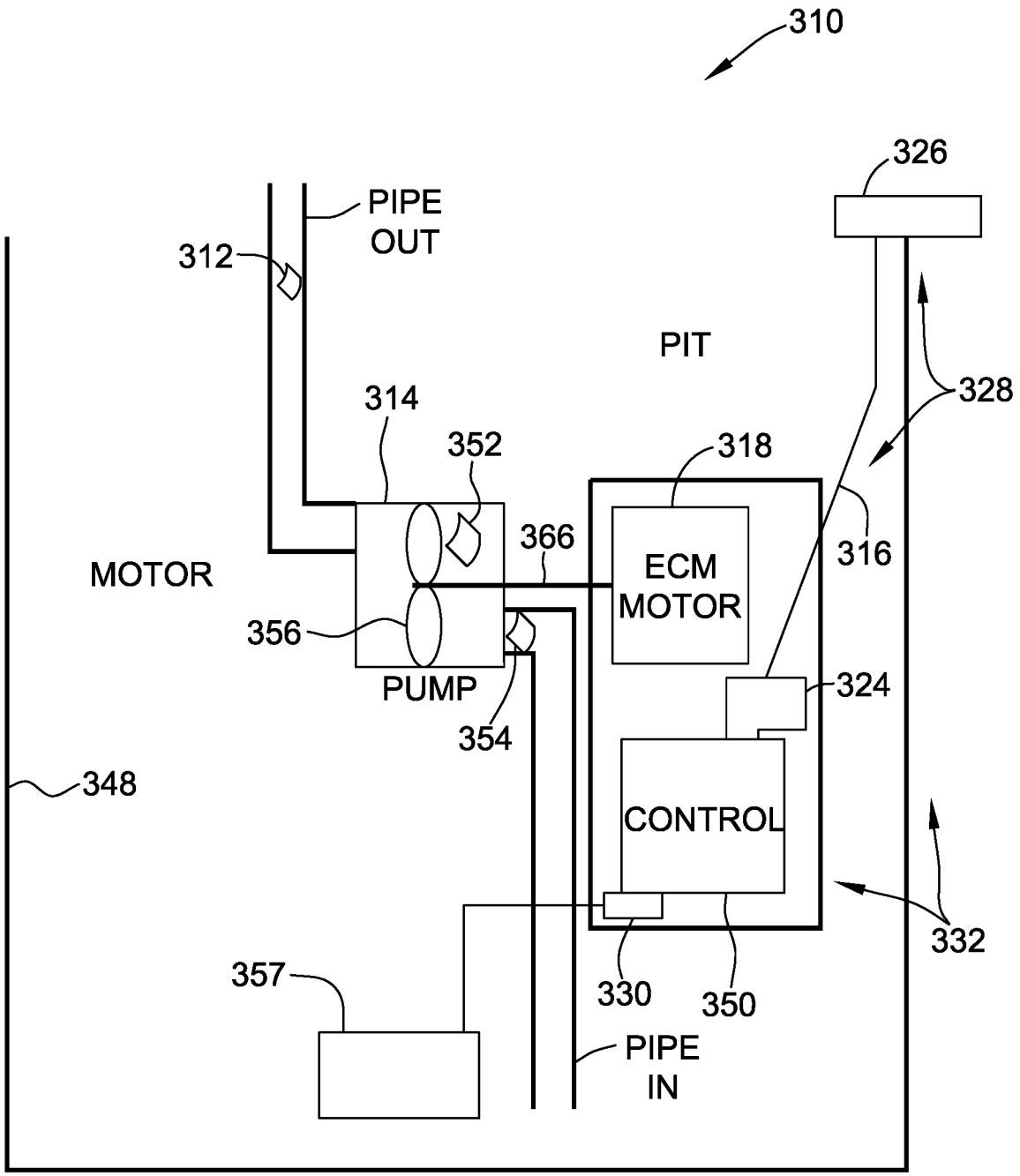
FIG. 4 is a plan view of an embodiment of the present invention in the form of a pumping device including an electronically commutated motor and a pump.

Referring now to FIG. 4, another aspect of the present invention is shown as pumping device 310 for pumping a fluid 312. The device 310 includes a pump 314 adapted for pumping the fluid 312 and an electronically commutated motor 318 operably connected to the pump 314 and adapted to provide energy to the pump 314. The device 310 also includes a controller 350 operably connected to the motor 318 and adapted to provide signals to the motor 318.

According to an aspect of the present invention the motor 318 may be adapted to operate at variable speeds. Such a motor 318 operable at different speeds may be, as shown, an ECM motor 318. It should be appreciated that the motor 318 with the variable speeds may have speeds adapted to match the incoming flow rate of the water in the pit 348. It should further be appreciated that the variable speeds of the motor with the variable speeds may be controlled to change the speeds of the motor to prevent water hammering.

According to another aspect of the present invention the motor 318 may be adapted to operate in a reverse direction to attempt to clear debris 352 from the intake 354 and/or the impeller 356. It should further be appreciated that the operation in the reverse direction may include a pulsing cycle to assist in clearing debris 352.

Further the impeller 356 may be so secured to shaft 366 that it will not release from the shaft 366 if turned in a direction opposed to the first direction.

According to another aspect of the present invention the sump pumping device 310 may include the controller 350. It should further be appreciated that the sump pumping device 310 may include means to connect power in for example line alternating or direct current to the controller 350. It should further be appreciated that the controller 350 may be adapted to charge a battery 324 with the AC or DC.

It should further be appreciated that the controller 350 may utilize DPT (direct power transfer) technology. It should further be appreciated that the controller 350 may be adapted to establish a signature or characteristics of the operating parameters of the system at initial startup and to compare actual operating parameters with the signature at initial startup. It should further be appreciated that the signature or characteristics include a torque profile. It should further be appreciated that the controller 350 may be adapted to monitor power used to fluid flow rate and compare that flow to incoming fluid to measure the proper operation of the overall system including at least one of check valves, pipe connections and pipe and other blockages. It should further be appreciated that the controller 350 may be adapted to operate at higher outputs to keep up with unusually high flow demands, such as those from heavy rains. It should further be appreciated that the controller 350 may be adapted to measure one of the torque, speed and power of the motor. It should further be appreciated that the controller may be adapted to determine a no-load condition, based on temperature and one of the torque, speed and power of the motor.

It should be appreciated that the pump 314 may be positioned adjacent to and connected to the motor 318. It should be appreciated that the motor 318 as well as the pump 314 may be at least partially enclosed within housing 316. For example, the housing 316 may enclose both the motor 318 and the pump 314. Such a configuration may provide a more compact configuration that may more easily be fitted into the pit and may be more easily and quickly installed into the pit. It should further be appreciated that the controller 350 may be positioned, as shown, within the housing 316 or, alternatively outside the housing 316.

As shown in FIG. 4, the motor 318 is powered by a primary power source 357. Typically, the primary power source 357 is line power for the residence and is typically 115 Volt or 230 Volt Alternating Current (AC). The primary power source 357 may be connected to the motor directly or as shown connected to the controller 350, The controller provides the primary power to the motor 318.

As shown in FIG. 4, the pumping device 310 may include a charging device 326 for charging the battery 324. It should further be appreciated that the charging may be de-sulfating charging, trickle charging, fast charging or deep cycle charging, or a combination of such charging.

As shown in FIG. 4, the battery 324 and the charging device 326 combine to form a backup power system or a battery system 328.

The charging device 326 may be a solar panel. The solar panel may be adapted to provide sufficient power to operate the motor 318. Alternatively, the panel 326 may only provide sufficient power to the controller 350 in the form of for example a microcontroller. The panel may also power a communication circuit (not shown) and other devices including for example a relay circuit (not shown). Such a solar panel may only need to provide a few watts of power.

The backup power system 328 may serve several purposes. One purpose is to provide power is that even there is no primary power 357, the panel 326 of the backup power system 328 will be able provide backup power for communication to the controller 350. This backup power may be used to provide information to the user to find out status of the pumping device 310 and do diagnostics on the pumping device 310.

Another purpose of the backup power system 328 is that the backup power system 328 in combination with an isolation circuit 330 forms an isolation system 332 that we will be able to isolate the controller 350 from the primary power 357 when the motor 318 is not running.

The primary power 357 is typically obtained from a power company that provides the power from a wide distribution network or power grid. The power grid is susceptible to power spikes and/or lightning strikes that can cause extensive damages to the residence including damage to electrical components, particularly electronic devices.

It should be appreciated that in much of time the pump 314 and motor 318 are not running. During that time by disconnecting the controller 350 from the primary power 357 or grid, the number of transients (including power surges and lightning strikes) the controller 350 may experience will be reduced. This reduction will, in return, extend the life of the pumping device 310.

The isolation circuit 330 may be designed as a redundant circuit. If the isolation circuit 330 fails, it will default to a connected state to grid so that the pump drive still can function. In such failure the isolation circuit 330 would provide a closed electrical connection between the primary power 357 and the controller 350. When the isolation circuit 330 is working properly, during the time when the pump 314 and the motor 318 are not running, which is most of the duty cycle, the circuit 330 provides an open or disconnected electric connection between the primary power 357 and the controller 350 and an open or disconnected electric connection between the primary power 357 and the motor 318. During the time when the circuit 330 provides an open or disconnected electric connection, the power to operate such circuit 330 and the power to operate such controller 350 is obtained from the backup power system 328.

It should be appreciated that the pumping device 310 may be used for a sump pump, as shown, or for a pool or spa. When used for a pool or spa, since such pool or spa is typically located outside or in direct exposure to the sun, using a solar panel as a charging device may be desirable. In such case, when the pump is in direct exposure to the sun, the solar panel 326 may be directly attached to the controller 360.

Figure 5:
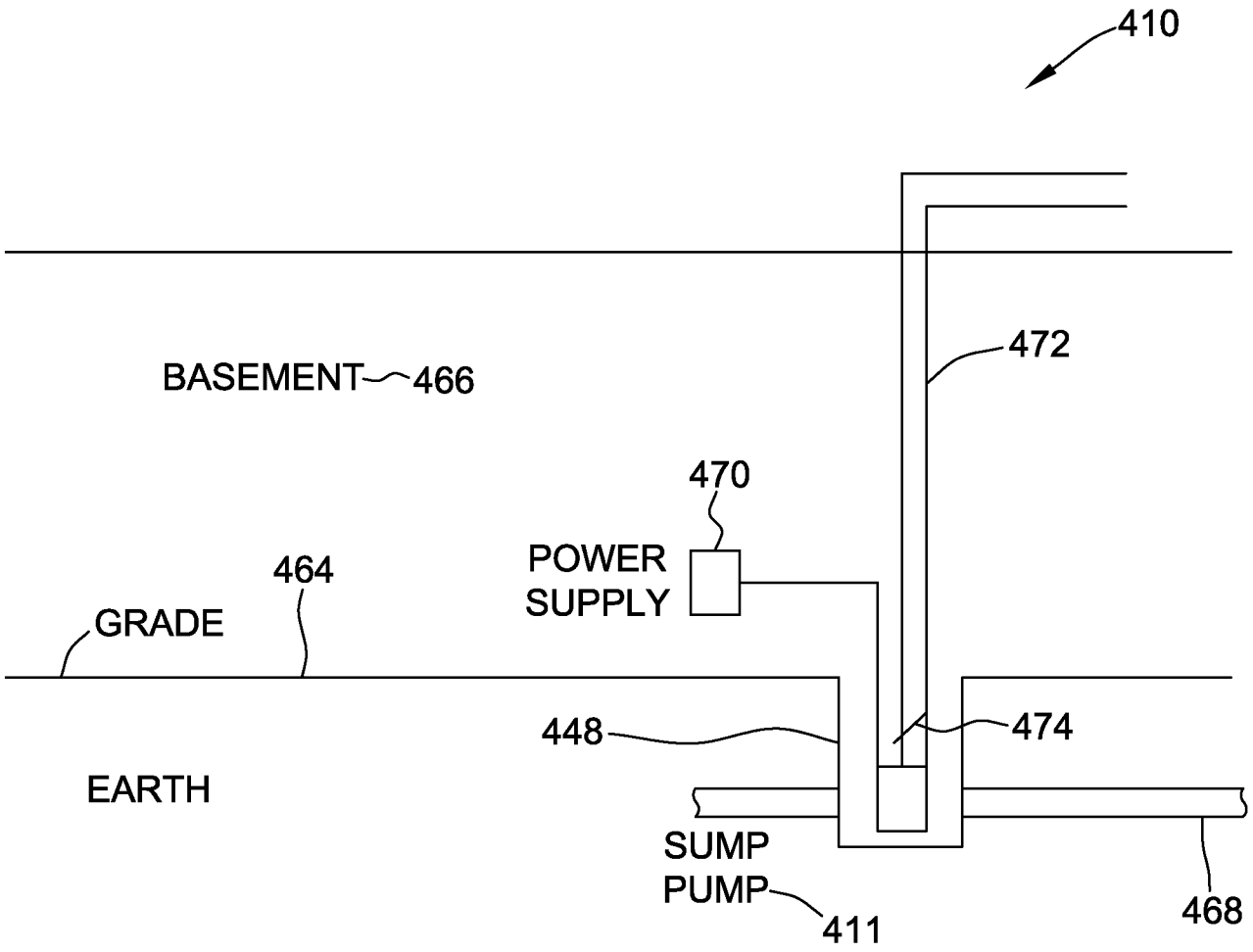
FIG. 5 is a schematic drawing of an embodiment of the present invention in the form of a fluid flow system.

Referring now to FIG. 5, another aspect of the present invention is shown as fluid flow system 410. The system 410 includes a pit 448 formed in floor 464 of basement 466. Drain lines 468 positioned around periphery of basement 466 are fed into pit 448 providing a conduit for subterranean water to flow into the pit 448. A sump pump 411 is placed in the pit 448 and is connected to discharge plumbing 472. The sump pump 411 may be any pump as disclosed as embodiments of the present invention herein. The pump 411 is powered by power supply 470. A check valve 474 is placed in the discharge plumbing to prevent water from returning to the pit 448 when the pump 411 is not running.

Figure 6:
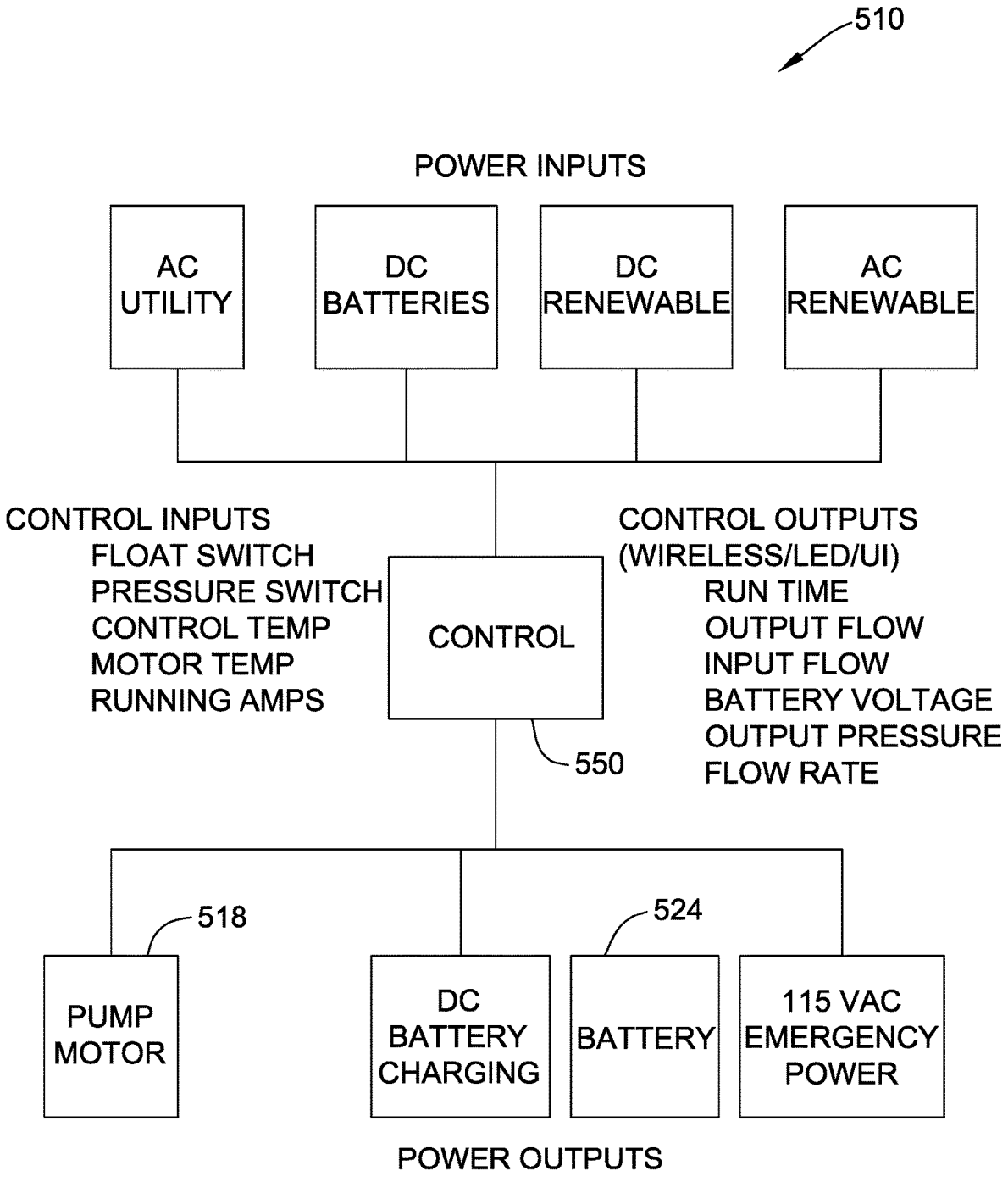
FIG. 6 is another schematic drawing of an embodiment of the present invention in the form of a fluid flow system.

Referring now to FIG. 6, another aspect of the present invention is shown as fluid flow system 510. The system 510 includes a pump motor 518 that may be any motor as disclosed as embodiments of the present invention herein. The motor 418 is controlled by control or controller 550. The controller 550 may have inputs including a float switch, a pressure switch, a controller temperature, a motor temperature and motor information including running amperes. The controller 550 may have outputs including run time, output flow, input flow, battery voltage, output pressure and pump flow rate. The controller 550 may provide signals to the motor 518 for controlling the motor 518. The system 510 may further include a battery 524 for providing direct current to the system 510. The controller 550 may further provide an output for charging the battery 524. The controller 550 may further provide an output in the form of 115 Volt AC emergency power. The system may obtain power for the system from AC utility power, from DC batteries, from DC renewable sources, such as wind or solar, and from AC renewable sources, such as wind or solar.

Figure 7:
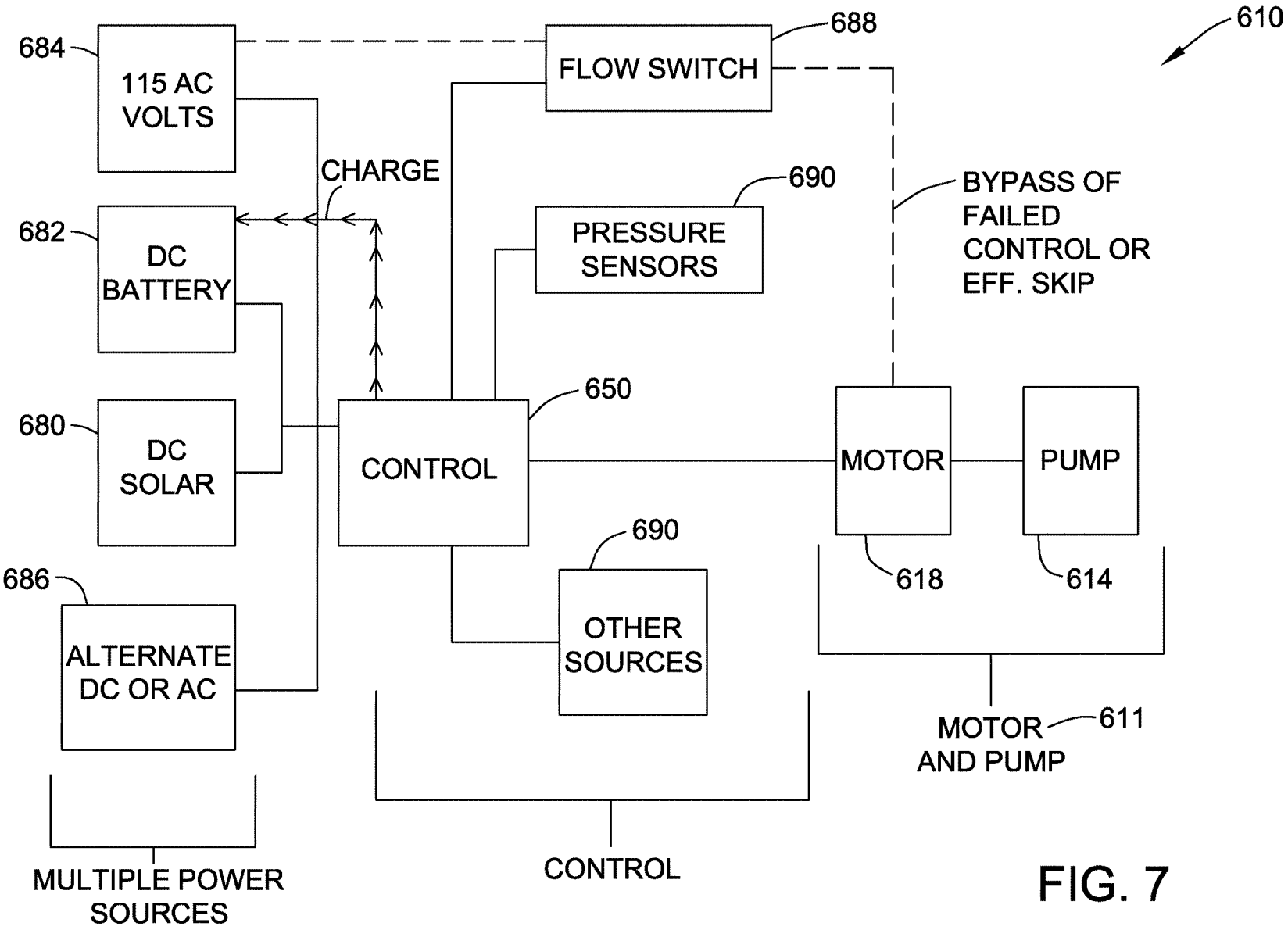
FIG. 7 is yet another schematic drawing of an embodiment of the present invention in the form of a fluid flow system.

Referring now to FIG. 7, another aspect of the present invention is shown as fluid flow system 610. The system 610 includes a sump pump 611 including a motor 618 that may be any motor as disclosed as embodiments of the present invention herein. The sump pump 611 also including a pump 618. The motor 618 is controlled by controller 650. The motor 618 is powered by one or more power sources 678. The power sources 678 may include DC Solar 680, DC battery 682, 115 AC 684, alternate AC and DC 686. The controller 650 may be used to charge battery 682. The system may include signal detecting devices such as a flow switch 688, pressure sensors 690 and other detecting sources 692 such as temperature sensors, current sensors, and voltage sensors. The motor 618 may be directly connected to a flow switch to operate and stop the motor if the controller 650 fails.

Figure 8:
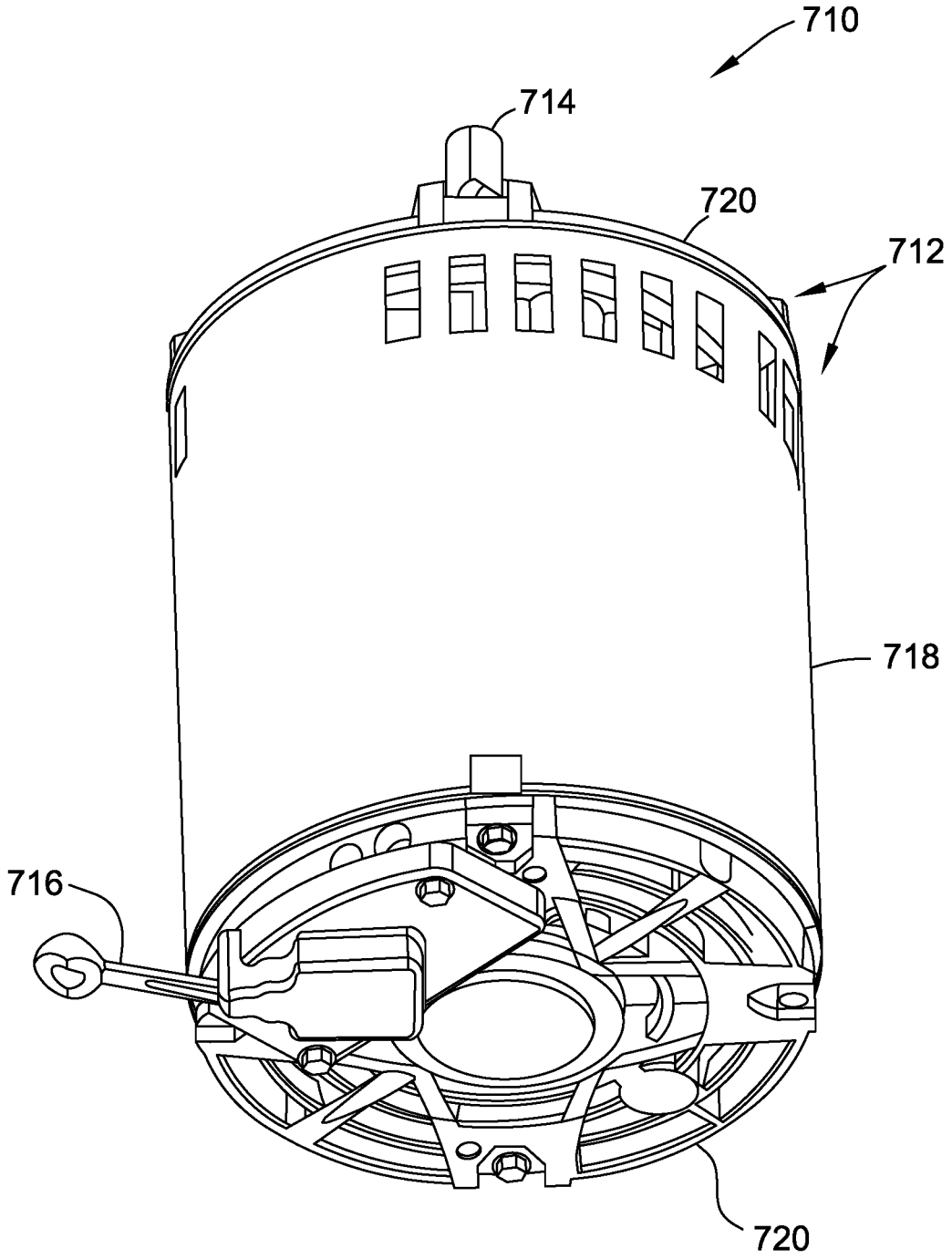
FIG. 8 is a perspective view of an embodiment of the present invention in the form of a motor assembly including two motors in a common housing.
Figure 9:
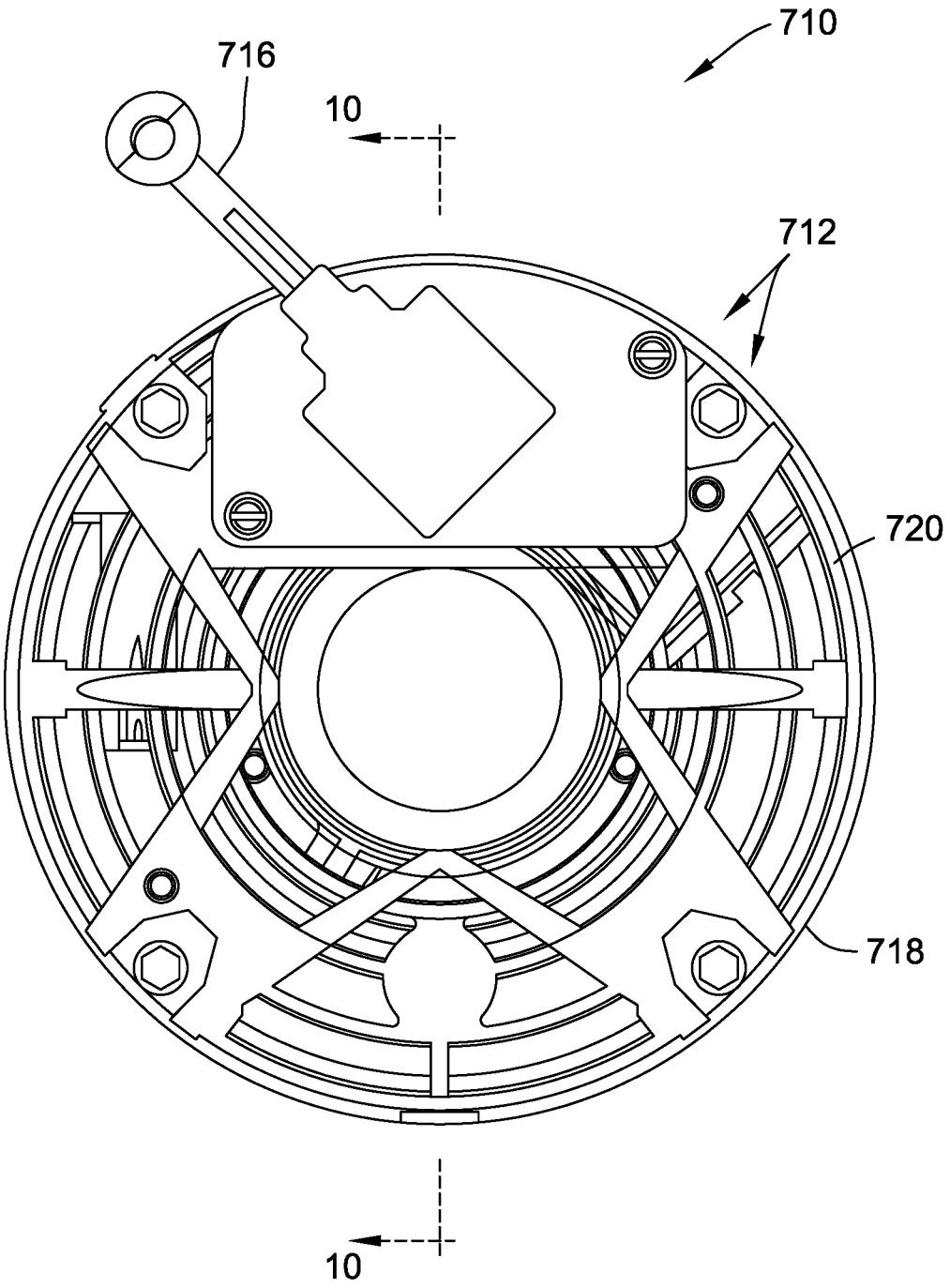
FIG. 9 is a plan view of the motor assembly of FIG. 8.
Figure 10:
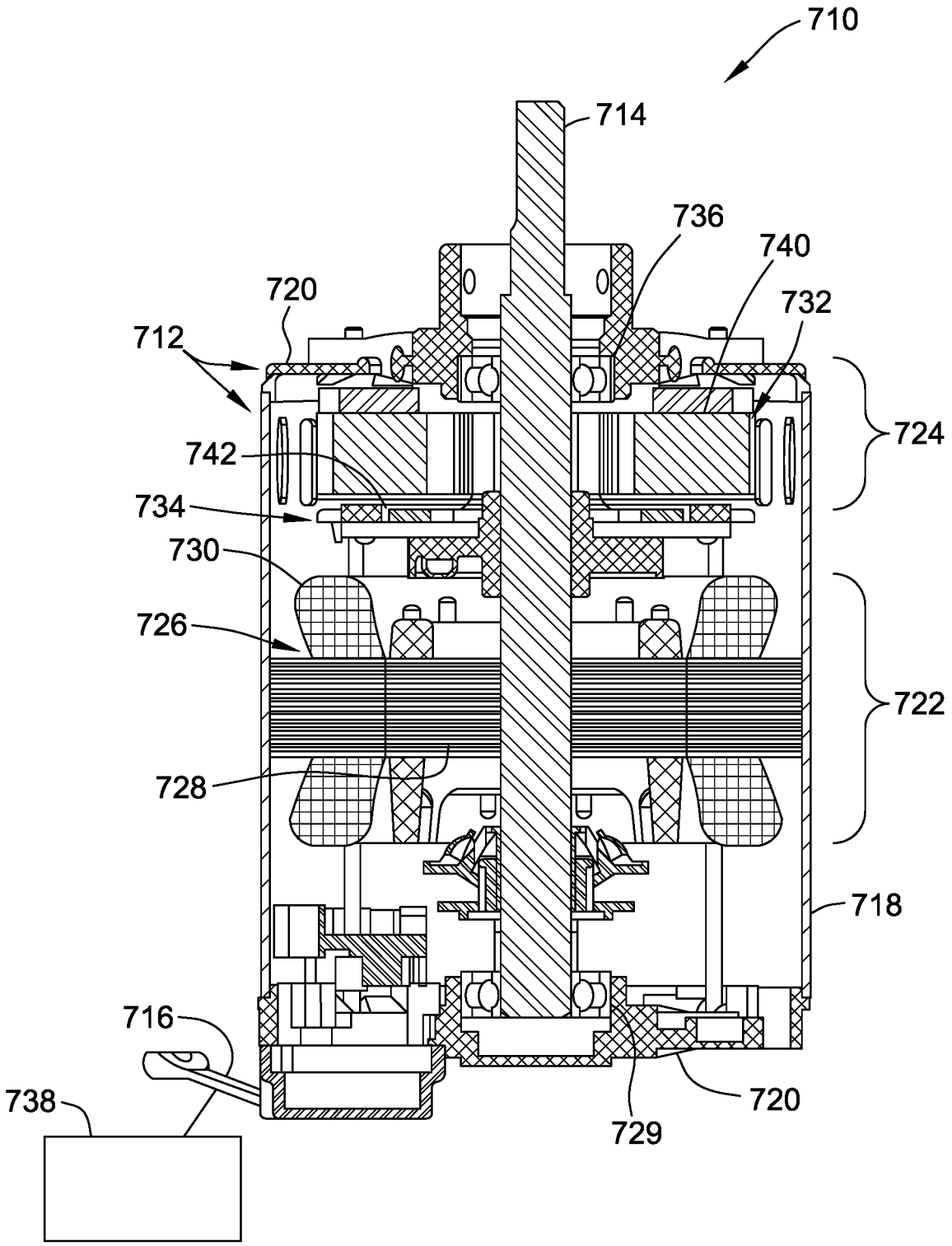
FIG. 10 is a partial cross-sectional view of FIG. 9 along the line 10-10 in the direction of the arrows.

Referring now to FIGS. 8-10, another aspect of the present invention is shown as a motor 710 for use with a pump for removing fluid collected from the subterranean surface adjacent a building is provided.

As shown in FIGS. 8 and 9, the motor 710 includes a housing 712 and an output shaft 714 configured for connection to the pump. The motor 710 is adapted to provide energy to the pump through the output shaft 714. The motor is connected to a power source (not shown) by a power lead 716. While the housing 712 may be unitary, as shown in FIG. 8, the housing 712 includes a cylindrical shell 718 and opposed end caps 720.

It should be appreciated that the motor 710 may be positioned adjacent to and connected to the pump. It should be appreciated that the motor 710 and the pump (not shown) may both be at least partially enclosed in the housing 712. For example, the housing 712 may enclose both the motor 710 and the pump. Such a configuration may provide a more compact configuration that may more easily be fitted into the pit and may be more easily and quickly installed into the pit.

Referring now to FIG. 10, the motor 710 includes a first motor 722 and a second motor 724. The use of two motors 722 and 724 provides for an active motor when and if one of the two motors fail. While not shown the motors 722 and 724 may be equipped with a clutch that releases the motor when its failure occurs so that the working motor may operate if the failed motor seizes. The first motor 722 is operably connected to the pump and is adapted to provide energy to the pump. As shown, at least a portion of the first motor 722 is positioned within the housing 712. As shown the first motor 722 is substantially positioned within the housing 712. Likewise, the second motor 724 is operably connected to the pump and is adapted to provide energy to the pump. As shown, at least a portion of the second motor 724 is positioned within the housing 712. As shown the second motor 724 is substantially positioned within the housing 712.

While the first motor 722 and the second motor 724 may be any suitable motors, as shown, the first motor 722 is an induction motor and the second motor 724 is an axial flux motor. The first motor 722 may be the primary motor and may be connected to line voltage of for example 115 V AC. The second motor 724 may be the backup motor and may be connected to line voltage and/or back up power in the form of for example, battery 12 Volt power.

As shown the first motor 722 may include a first motor stator 726 connected to the housing 712 and a first motor rotor 728 rotatably connected to the stator 726 by bearings 729. The first motor stator 726 and/or the first motor rotor 728 may include electromagnetic coils. As shown the stator 726 has electromagnetic coils or windings 730. While as shown the first motor 722 is an induction motor, it should be appreciated that the first motor may be a permanent magnet motor with permanent magnets fitted to the rotor.

The second motor 724 may, as shown, be an axial flux motor. As shown the second motor 724 may include a second motor stator 732 connected to the housing 712 and a second motor rotor 734 rotatably connected to the second motor stator 732 by bearings 736. As shown the second motor 724 is a variable speed motor. For example, the second motor 724 is an electronically commutated motor. For example, the electronically commutated motor may use a trapezoidal drive or a sinusoidal drive. The second motor 724 may also include a controller 738 operably connected to the second motor 724. The controller serves to control the second motor and may be used to adjust the speed of the second motor 724. The controller 738 may, as shown, be external to the housing 712 or may alternatively be positioned within the housing 712.

The second motor stator 732 and/or the second motor rotor 734 may include electromagnetic coils. As shown the first motor stator 732 has electromagnetic coils or windings 740. The second motor rotor 734 of the second motor 724 may, as shown, include permanent magnets 742 connected to the rotor 734.

As shown, the motor 710 may include a temperature sensor (not shown) positioned adjacent one of the windings 730 or 740 and the controller 738. The controller 738 and the sensor adapted to monitor the temperature of either or both windings 730 and 740 and the controller 738. It should further be appreciated that the controller 738 may be adapted to utilize a temperature obtained from temperature sensor to maximize system performance.

As shown the second motor 724 is a variable speed motor that may include speeds to match with the pump and the system requirements to maximize flow and efficiency or both.

As shown the first motor 722 and/or the second motor 724 may be a high-speed motor. It should further be appreciated that the high-speed motor may be adapted to operate at around 18,000 RPM or higher.

It should be appreciated that the second motor may be an ECM motor. The use of an axial flux motor as the second motor 724 provides for a motor with reduced length along the rotational axis. Such shorter length of the motor may be advantageous for fitting the motor 710 into a sump pit. It should further be appreciated that the second motor may be a backup motor. It should further be appreciated that the backup motor may be periodically operated. It should further be appreciated that the controller may be configured to perform diagnostics on the system using outputs from the second motor 724, whether a primary or a backup motor.

It should be appreciated that the motor 710 may be configured such that first motor stator 726 of the first motor 722 may operate at a high voltage and the second motor stator 732 of the second motor 724 may operate at a low voltage. It should be appreciated that the low voltage may be 50 volts or less. It should be appreciated that the high voltage may be 100 volts or greater.

It should be appreciated that the motor 710 may be configured such that the winding 730 of the first motor 722 may operate at a high voltage and the winding 740 of the second motor 724 may operate at a low voltage. It should be appreciated that the motor 710 may include a switching mechanism (not shown). It should be appreciated that the switching mechanism may be adapted to switch the first winding and/or the second winding between a first mode in which the winding operates at a high voltage and second mode in which the winding operates at a low voltage.

It should be appreciated that the controller 738 may be adapted to provide for wireless monitoring. It should be appreciated that the wireless monitoring may be from one of a computer desktop or a portable computer device. It should be appreciated that the portable computer device may be an iPhone, a tablet or an android.

Figure 11:
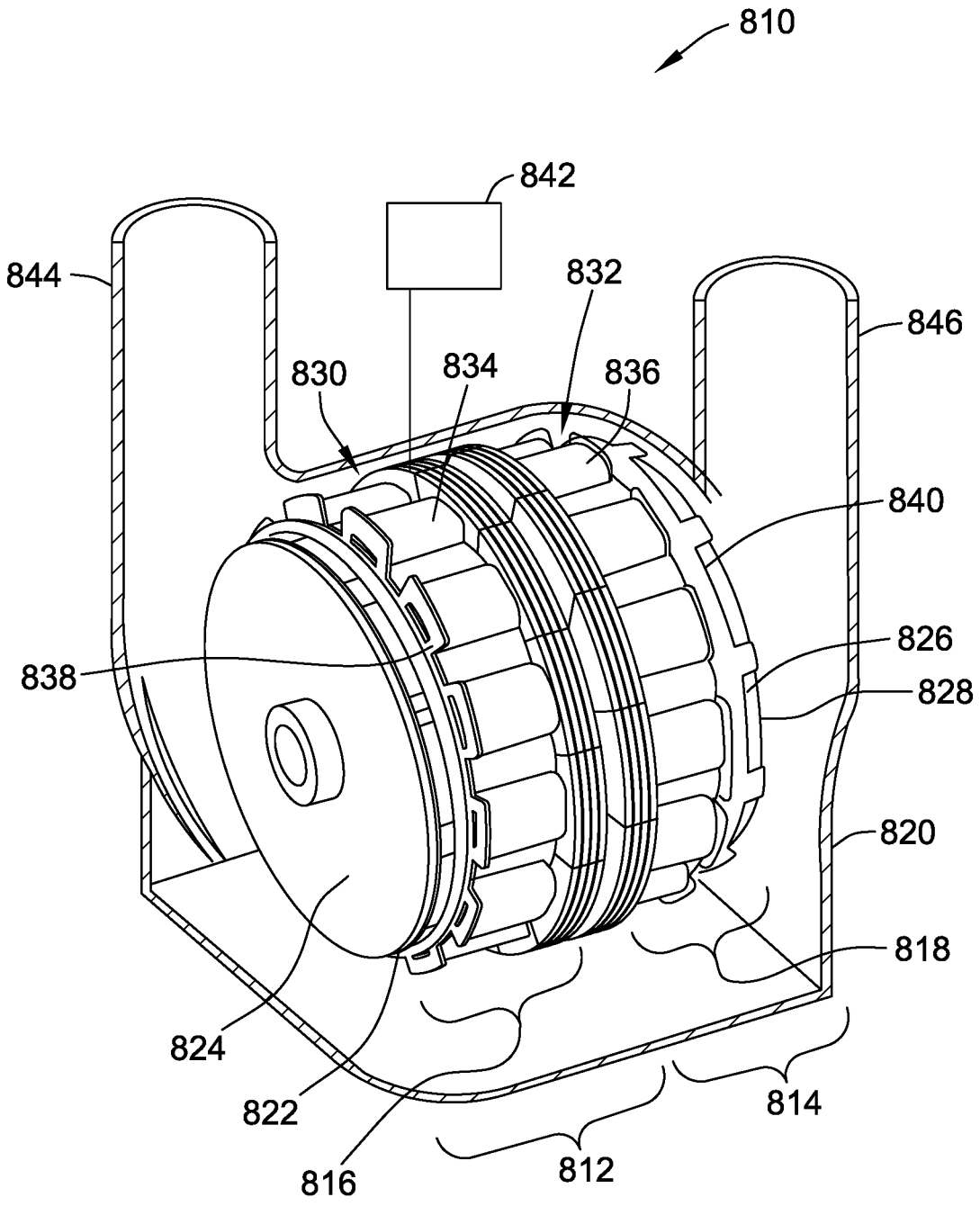
FIG. 11 is a perspective view of another embodiment of the present invention in the form of a sump pump including two pumps, each with its own motor in a common housing.

Referring now to FIG. 11, another aspect of the present invention is shown as a pumping device 810 for removing fluid collected from the subterranean surface adjacent a building is provided. Unlike the pumping devices of FIGS. 1-10, the pumping device 810 includes a first pump 812 and a second pump 814.

The first pump 812 is driven by first motor 816 and likewise the second pump 814 is driven by second motor 818. The use of two motors 816 and 818 provides for an active motor when and if one of the two motors fail. The rotating components of the motors 816 and 818 are not connected to each other, such that when a rotation component of one motor seizes, such a seizure does not affect the other motor. The first motor 816 is operably connected to the first pump 812 and is adapted to provide energy to the first pump 812. Likewise, the second motor 818 is operably connected to the second pump 814 and is adapted to provide energy to the second pump 814.

As shown, the pumping device 810 includes a housing 820. As shown, at least a portion of the first motor 816 is positioned within the housing 820. As shown, the first motor 816 is substantially positioned within the housing 820. Likewise, at least a portion of the second motor 818 is positioned within the housing 820. As shown the second motor 818 is substantially positioned within the housing 820.

As shown, at least a portion of the first pump 812 is positioned within the housing 820. As shown, the first pump 812 is substantially positioned within the housing 820. Likewise, at least a portion of the second pump 814 is positioned within the housing 820. As shown the second pump 814 is substantially positioned within the housing 820.

While the first motor 816 and the second motor 818 may be any suitable motors, as shown, the first motor 816 and the second motor 818 are axial flux motors. Preferably one of these axial flux motors is an electronically commutated motor. At least one of the axial flux motors could be a non-electronically commutated motor. For example, one of the motors, the second motor 818 could be a non-variable speed line start axial flux motor.

As shown in FIG. 11, the first motor 816 include a first motor rotor 822. Further, the first pump 812 may include a first pump impeller 824. As shown, the first motor rotor 822 and the first pump impeller 824 may be juxtaposed and operably connected to each other. It should be appreciated that the first motor rotor 822 and the first pump impeller 824 may be integral to each other. It should be appreciated that the first pump impeller 824 and the housing 820 substantially include the first pump 812.

Further, the second motor 818 include a second motor rotor 826. Further, the second pump 814 may include a second pump impeller 828. As shown, the second motor rotor 826 and the second pump impeller 828 may be juxtaposed and operably connected to each other. It should be appreciated that the second motor rotor 826 and the second pump impeller 828 may be integral to each other. It should be appreciated that the second pump impeller 828 and the housing 820 substantially include the second pump 814.

The first motor 816 may also include a first motor stator 830 operably associated with the first motor 816. Similarly, the second motor 818 may also include a second motor stator 832 operably associated with the second motor 818.

It should be further appreciated that the first motor stator 830 or the second motor stator 832 may operate at a high voltage and that the other of first motor stator 830 or the second motor stator 832 may operate at a low voltage.

As shown, the first motor stator 830 includes first motor stator coils or windings 834 for generating an electromagnetic flux and the second motor stator 832 includes first motor stator coils or windings 836 for generating an electromagnetic flux.

Also, the first motor rotor 822 includes first motor rotor magnets 838 for generating magnetic flux and the second motor rotor 826 includes second motor rotor magnets 840 for generating magnetic flux.

As shown, the pumping device 810 further includes a control or controller 842 for controlling at least one of the first motor 816 and the second motor 818. The controller 842 serves to control the second motor, provided the second motor 818 is a variable speed motor, for example a variable speed electronically commutated motor. It should be appreciated that the first motor 816 may be controlled by the controller 842, particularly if the first motor 816 is a variable speed motor.

As shown, the first pump 812 includes a first pump inlet (not shown) and a first pump outlet 844. As shown the second pump 814 includes a first pump inlet (not shown) and a first pump outlet 846.

Figure 12:
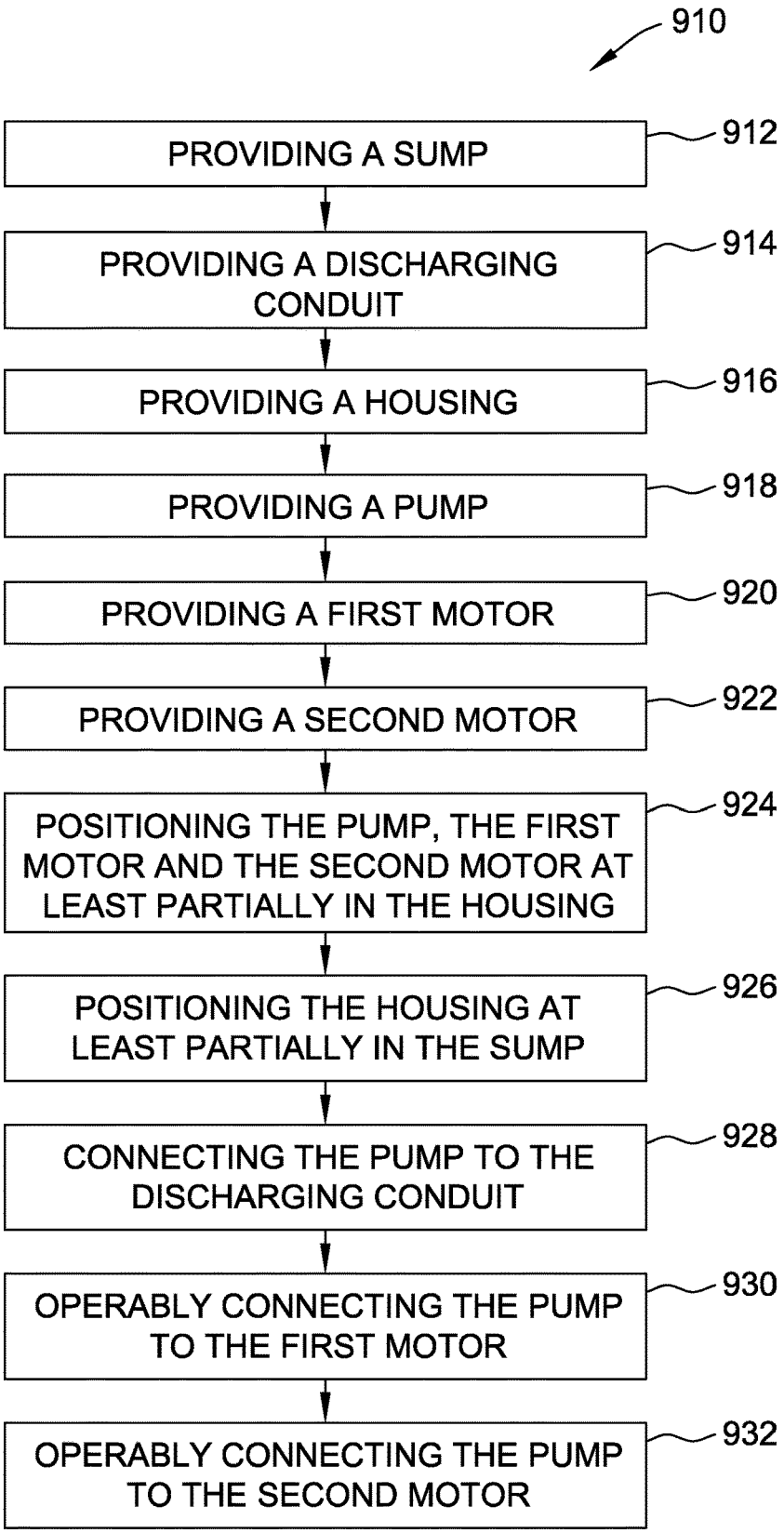
FIG. 12 is a flow chart of a method of removing fluid according to another aspect of the present invention.

Referring now to FIG. 12, another aspect of the present invention is shown as a method 910 for removing fluid from subterranean surface of a building. The method includes step 912 of providing a sump, step 914 of providing a discharging conduit, step 916 of providing a housing, step 918 of providing a pump, step 920 of providing a first motor, and step 922 of providing a second motor. The method also includes step 924 of positioning the pump, the first motor and the second motor at least partially in the housing. The method also includes step 926 of positioning the housing at least partially in the sump and step 928 of connecting the pump to the discharging conduit. The method also includes step 930 of operably connecting the pump to the first motor and step 932 of operably connecting the pump to the second motor.

Figure 13:
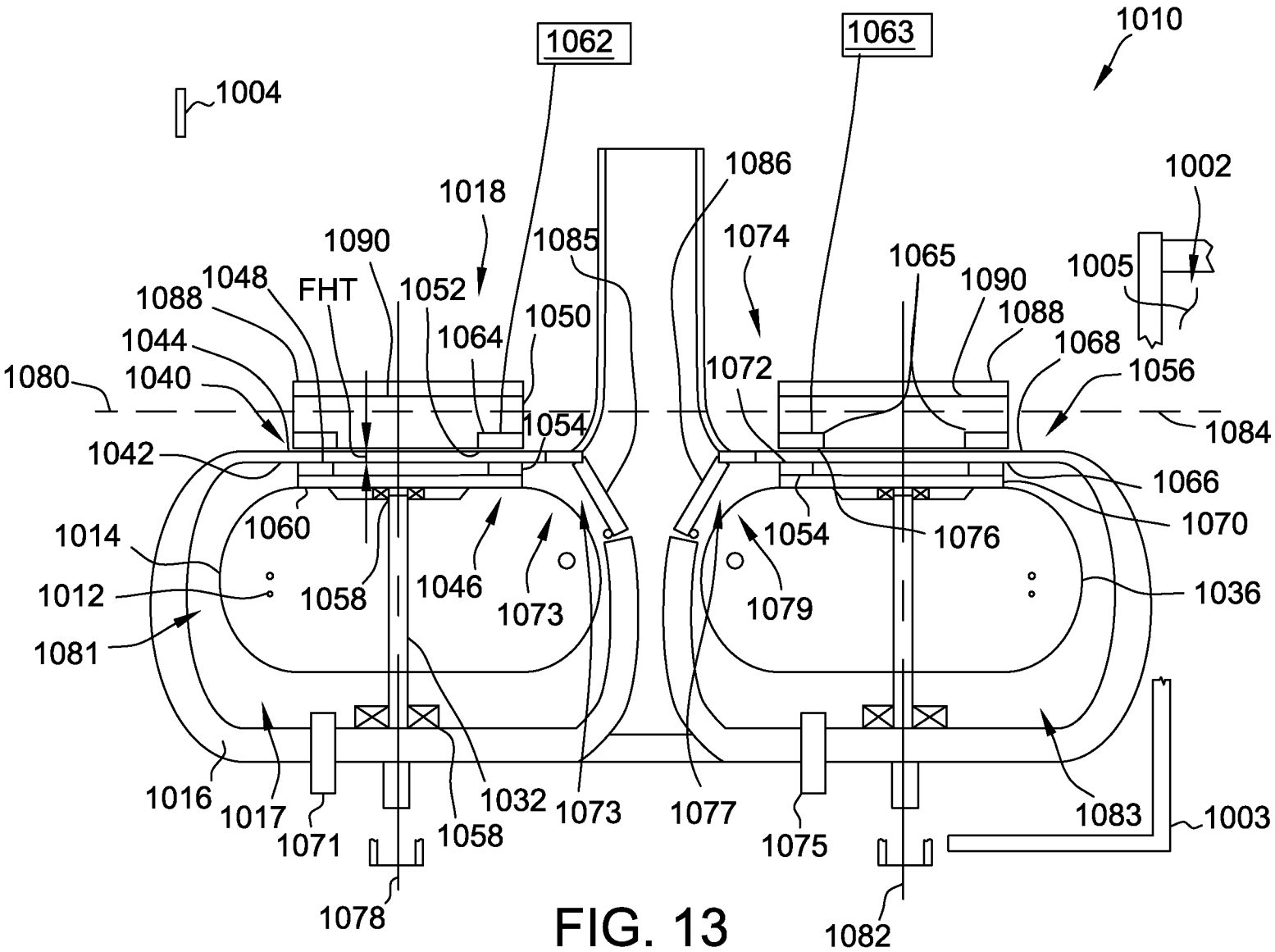
FIG. 13 is a plan view, partially in cross section of another embodiment of the present invention in the form of a pump having two axial flux motors positioned spaced beside each other with each axial flux motors having a plate between the rotor and stator of the motor to permit the rotor and the impeller of each motor to have an internal shaft without a shaft seal.

Referring now to FIG. 13, another aspect of the present invention is shown as pump 1010 for removing fluid 1012 collected from the subterranean surface 1002 adjacent a building 1004. The pump 1010 includes a housing 1016 defining a cavity 1017 therein. The housing 1016 includes a first portion 1040 thereof defining opposed parallel spaced apart internal and exterior generally planar surfaces 1042 and 1044, respectively. The pump 1010 also includes a first impeller 1014 rotatably secured to the housing 1016 and positioned within the housing 1016. The pump 1010 also includes a first axial flux motor 1018 connected to the first impeller 1014 and at least partially positioned within the housing 1016.

The first axial flux motor 1018 includes a first motor rotor 1046 fixedly secured to the first impeller 1014. The first motor rotor 1046 has a generally planar surface 1048 thereof positioned adjacent to and parallel to the internal generally planar surface 1042 of the first portion 1040 of the housing 1016. The first axial flux motor 1018 includes a first motor stator 1050 fixedly secured to the housing 1016. The first motor stator 1050 has a generally planar surface 1052 thereof positioned adjacent to and parallel to the external generally planar surface 1044 of the first portion 1040 of the housing 1016.

Figure 13A:
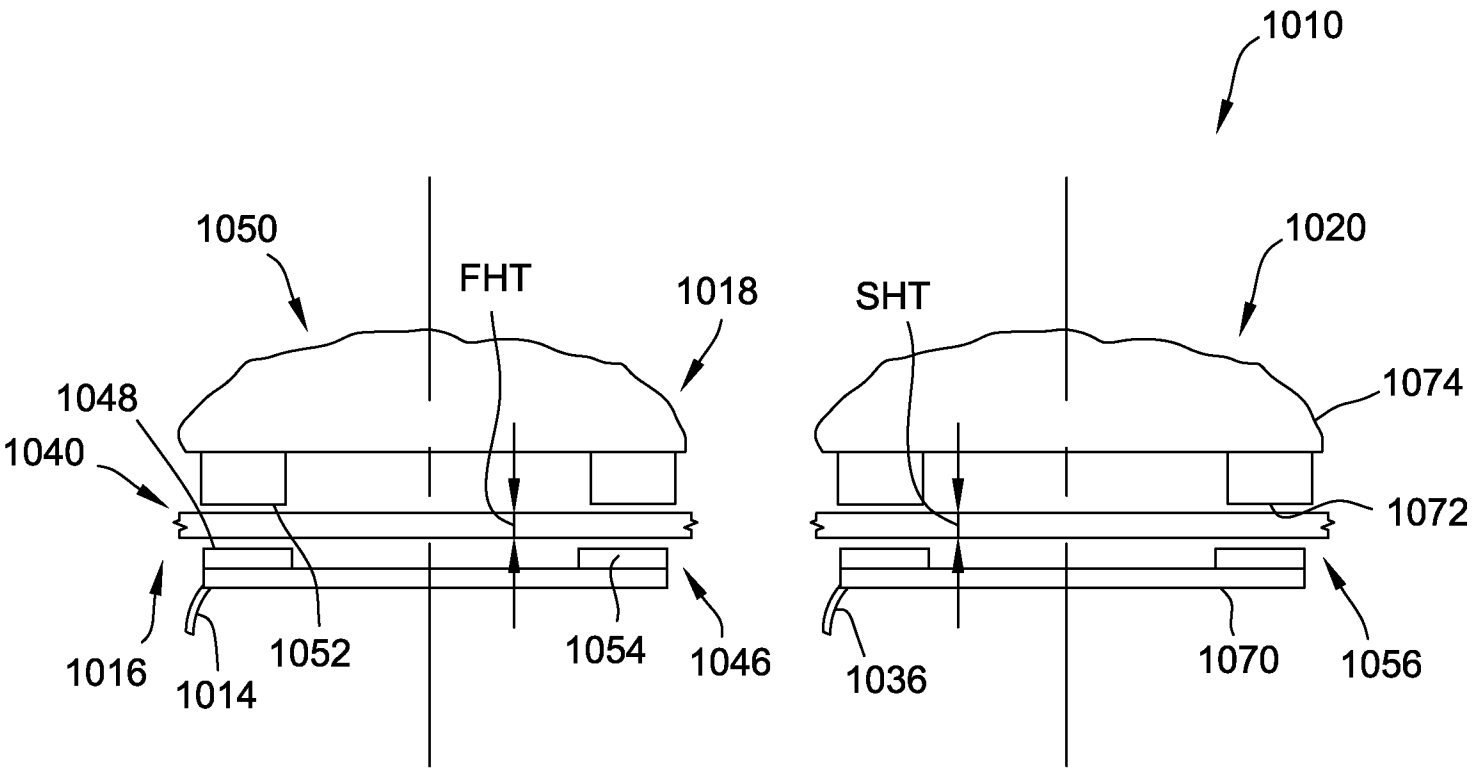
FIG. 13A is a partial plan view, partially in cross section of FIG. 13, showing the plate in greater detail.

According to an aspect of the invention and referring now to FIG. 13A, the first portion 1040 of the housing 1016 positioned between the generally planar surface 1052 of the first stator 1050 and the generally planar surface 1048 of the first rotor 1046 has a first thin cross sectional thickness FHT that is made as thin as possible to provide a housing of sufficient strength to support the first rotor 1046, the first stator 1050 and the first impeller 1014. For example, the first thin cross-sectional thickness FHT may be 0.005 to 0.180 inches.

The first portion 1040 of the housing 1016 is preferably made of a material that has proper electrical conductivity and proper magnet conductivity to permit the first rotor 1046 and the first stator 1050 to be on opposite sides of the first portion 1040 and still convey the magnetic forces necessary to permit the first motor 1018 to rotate with sufficient force and velocity to move a sufficient quantity of fluid 1012 through the impeller 1014. The first portion 1040 of the housing 1016 may be made of, for example, stainless steel or other material with similar magnetic and electrical properties.

The first rotor 1046 may have may have any suitable shape and may be made of any suitable materials. The first rotor 1046 may include a plurality of spaced apart magnets 1054. The magnets may extend axially from one face of the rotor 1046 and the distal end of the magnets 1054 may define the generally planar surface 1048 of the rotor 1046. The magnets 1054 may be permanent magnets 1054. For example, the magnets 1054 may be rare earth magnets, for example, neodymium magnets. The rotor 1046 may be rotatably secured to the housing by a first motor shaft 1032 mounted to the housing 1016 by bearings 1058 rotatably secured to shaft and fixedly secured to housing. It should be appreciated that the first motor shaft 1032 may be supported internally within the housing 1016 eliminating any need for shaft seals in the housing.

The first impeller 1014 may have any suitable shape and may be made of any suitable materials. As shown in FIG. 13, the first impeller 1014 is secured to lower surface 1060 of the first rotor 1046. The impeller 1014 may be made of any suitable materials and may be secured to the rotor 1046 by any suitable method, such as, for example, by fasteners, welding or molding.

Power is supplied from a power source 1062 to energized coils 1064 positioned in the first stator 1050. The coils 1064 in the stator 1050 cooperate with the magnets 1054 in the rotor 1046 to rotate the rotor and the impeller 1014.

As shown in FIG. 13 and according to another aspect of the present invention, the pump 1010 may be configured such that the housing 1016 includes a second portion 1056 thereof defining opposed parallel spaced apart internal and exterior generally planar surfaces, 1066 and 1068 respectively.

The second portion 1056 provides the pump 1010 with a location for a second axial flux motor 1020 operably connected to a second impeller 1036. At least a portion of the second axial flux motor 1020 may be positioned within the housing 1016.

According to another aspect of the present invention, the pump 1010 may further include a second impeller 1036 rotatably secured to the housing 1016 and positioned within the housing 1016.

According to another aspect of the present invention, the second axial flux motor 1020 may further include a second motor rotor 1070 fixedly secured to the second impeller 1036. The second motor rotor 1070 may have a generally planar surface 1072 thereof positioned adjacent to and parallel to the internal generally planar surface 1066 of the second portion 1056 of the housing 1016.

According to another aspect of the present invention, the pump 1010 may further include a second motor stator 1074 fixedly secured to the housing 1016. The second motor stator 1074 has a generally planar surface 1076 thereof positioned adjacent to and parallel to the external generally planar surface 1068 of the second portion 1056 of the housing 1016.

Power is supplied from a second power source 1063 to energized coils 1065 positioned in the second motor stator 1074. The coils 1065 in the stator 1074 cooperate with the magnets 1054 in the second motor rotor 1070 to rotate the second rotor 1070 and the second impeller 1036.

Note that the use of a first power source 1062 and a second power source 1063 provides for redundancy and provides for a more robust system for removing water from a basement. If the first motor 1018 fails or there is a disruption in the first power source 1062 circuit, the second motor 1020 may still be powered by the second power source 1063 and continue to remove water from pit 1003.

Further, if the second motor 1020 fails or there is a disruption in the second power source 1063 circuit, the first motor 1018 may still be powered by the first power source 1062 and continue to remove water from the pit 1003.

According to an aspect of the invention and referring again to FIG. 13A, the second portion 1056 of the housing 1016 positioned between the generally planar surface 1076 of the second motor stator 1074 and the generally planar surface 1072 of the second rotor 1070 has a second thin cross sectional thickness SHT that is made as thin as possible to provide a housing of sufficient strength to support the second rotor 1070, the second stator 1074 and the second impeller 1036. For example, the second thin cross-sectional thickness SHT may be 0.005 to 0.180 inches.

It should be appreciated that the second motor 1020 may be identical to the first motor 1018 or be different from the first motor 1018. The second impeller 1036 may be identical or different from the first impeller 1014. If, as is shown in FIG. 13, the second motor is positioned beside the first motor 1018, the second impeller 1036 may be a mirror image of the first impeller 1014, so that the impellers 1014 and 1036 may have outlets 1069 and 1079 that merge together urging a common stream of fluid 1012 from the pump 1010 in a common direction.

According to another aspect of the present invention and continuing to refer to FIG. 13, the pump 1010 may be configured such that the first axial flux motor 1018 has a rotational centerline 1078 and a traverse centerline 1080 normal to the rotational centerline. Further, the pump 1010 may be configured such that the second axial flux motor 1020 has a rotational centerline 1082 and a traverse centerline 1084 normal to the rotational centerline. The traverse centerline 1080 of the first axial flux motor 1018 and the traverse centerline 1084 of the second axial flux motor 1020 may be coincident. In other words. the pump 1010 may have two motors 1018 and 1020 that are positioned in a side by side relationship.

It should be appreciated that the pump 1010 may be configured such that the rotational centerline 1078 of the first axial flux motor 1018 and the rotational centerline 1082 of the second axial flux motor 1020 may be coincident. In other words. the pump 1010 may have two motors 1018 and 1020 that are positioned such that one is on top of the other (not shown).

According to another aspect of the present invention, the pump 1010 may be configured such that the housing 1016 defines a first cavity portion 1081 within the housing cavity 1017 for receiving the first motor impeller 1014. The first cavity portion 1081 and the housing 1016 may define a first cavity fluid inlet port 1071 and a first cavity fluid outlet port 1073.

According to another aspect of the present invention, the pump 1010 may be configured such that the housing 1016 defines a second cavity portion 1083 within the housing cavity 1017 for receiving the second motor impeller 1036. The second cavity portion 1083 and the housing 1016 may define a second cavity fluid inlet port 1075 and a second cavity fluid outlet port 1077.

According to another aspect of the present invention, the pump 1010 may further include a first check valve 1085 secured to the first cavity fluid outlet port 1073 for permitting the flow of fluid from the first cavity portion 1081 and for prohibiting the flow of fluid into the first cavity portion 1081.

According to another aspect of the present invention, the pump 1010 may be configured such that first motor rotor 1446 includes shaft 1432 for supporting the rotor 1446 and such that the shaft 1432 is entirely contained within the housing 1416. Keeping the rotor shaft totally within the housing 1416 obfuscates the need for a shaft seal for the rotor shaft. The lack of a shaft seal may improve reliability.

According to another aspect of the present invention, the pump 1010 may further include a second check valve 1086 secured to the second cavity fluid outlet port 1077 for permitting the flow of fluid from the second cavity portion 1083 and for prohibiting the flow of fluid into the second cavity portion 1083.

It should be appreciated that the pump 1010 may be placed in pit 1003 extending downwardly from the surface 1002 of a building 1004. The pump 1010 may be totally or partially submerged below water line 1005 of the pit 1003.

To accommodate surviving in a submerged environment, the pump 1010 may be made of materials that are resistant to rusting or other water aggravating conditions. For example, the pump 1010 may be made of polymers, composites, aluminum or stainless steel. The cavity 1017 of housing 1016 may be filled with water and the bearings 1058 may be water bearing or sleeve bearings. The flow of water through the impellers 1014 and 1036 may be used to cool the bearings 1058, the impellers 1014 and 1036 and the rotors 1046 and 1070.

To cool the stators 1050 and 1074, water may pass by the first portion 1040 and the second portion 1056 of the housing 1016. This water will cool the first portion 1040 and the second portion 1056 and the stators 1050 and 1074 which are mounted to the portions 1040 and 1056.

To prevent grounding of the stators 1050 and 1074, the stators 1050 and 1074 may be encapsulated in a polymer. Alternatively, the stators 1050 and 1074 may be filled with an oil.

It should be appreciated that the pump may be configured such that the first axial flux motor 1018 and/or the second axial flux motor 1020 is an Electronically Commutated Motor (an ECM motor). It the motors 1018 and 1020 are ECM motors, the pump may further include a controller 1088 for controlling the rotational speed of the motors 1018 and 1020. Each of the motors 1018 and 1020 may have a separate controller 1088. The controllers 1088 may be positioned on top surface 1090 of the stator 1050 or 1074 their respective motor 1018 or 1020 and, as such, be positioned outside the housing 1016. The controllers may be encapsulated in a polymer or may be encapsulated in an oil.

According to another aspect of the present invention and referring now to FIGS. 14-17, a pump 1110 for removing fluid 1112 collected from the subterranean surface 1102 adjacent a building 1104 may be provided. The pump 1110 may include a housing 1116 defining a cavity 1117 therein and a first motor impeller 1114 rotatably secured to the housing 1116 and positioned within the cavity 1117. The pump 1110 may further include a first axial flux motor 1118 having a rotational centerline 1178 and a traverse centerline 1180 normal to the rotational centerline. The first axial flux motor 1118 may be connected to the first motor impeller 1114 and at least partially positioned within the housing 1116.

According to another aspect of the present invention, the first axial flux motor 1118 may include a first motor rotor 1146 fixedly secured to the first motor impeller 1114 and a first motor stator 1150 fixedly secured to the housing 1116.

According to another aspect of the present invention, the pump 1110 may include a second motor impeller 1136 rotatably secured to the housing 1116 and positioned within the cavity 1117 and a second axial flux motor 1120.

According to another aspect of the present invention, the second axial flux motor 1120 may have a rotational centerline 1182 and a traverse centerline 1184 normal to the rotational centerline. The second axial flux motor 1120 may be connected to the second motor impeller 1136 and at least partially positioned within the housing 1116. The traverse centerline 1180 of the first axial flux motor 1118 and the traverse centerline 1184 of the second axial flux motor 1120 may be coincident. In other words, the motors 1118 and 1120 may, as shown, be positioned side by side.

According to another aspect of the present invention, the second axial flux motor 1120 may further include a second motor rotor 1170 fixedly secured to the second motor impeller 1136 and a second motor stator 1174 fixedly secured to the housing 1116.

Figure 16:
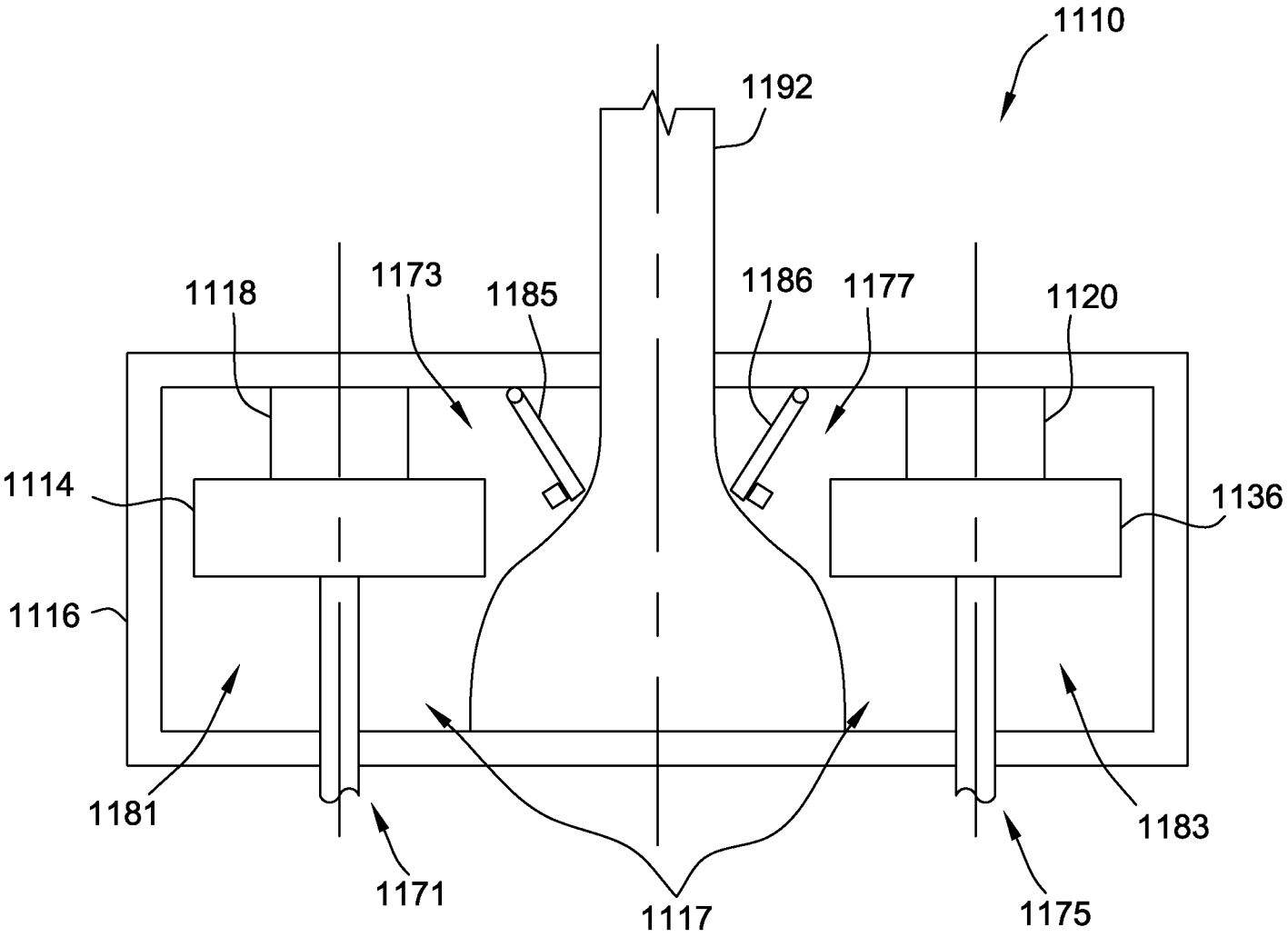
FIG. 16 is a plan view, partially in cross section of the pump of FIG. 15 showing the check valves in the pump cavity to assist in proper operation of the pump.

As shown in FIG. 16 and according to another aspect of the present invention, the pump 1110 may be configured such that the housing 1116 defines a first cavity portion 1181 within the housing cavity 1117 for receiving the first motor impeller 1114. The housing 1116 may define a first cavity fluid inlet port 1071 and a first cavity fluid outlet port 1173.

According to another aspect of the present invention, the pump 1110 may be configured such that the housing 1116 defines a second cavity portion 1183 within the motor cavity 1117 for receiving the second motor impeller 1136. The housing 1116 may define a second cavity fluid inlet port 1175 and a second cavity fluid outlet port 1177.

Figure 17:
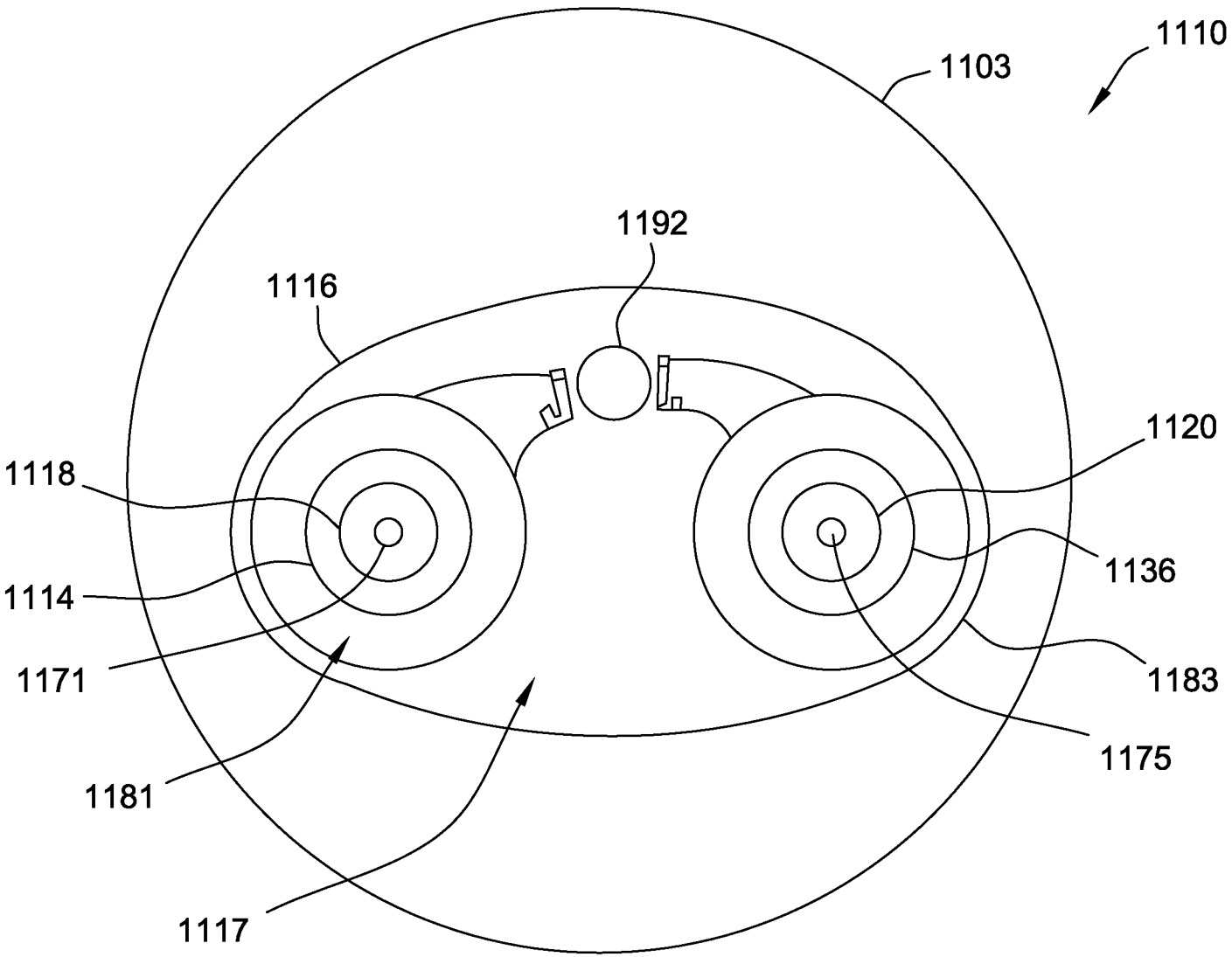
FIG. 17 is a top view, partially in cross section of the pump of FIG. 15 showing the layout of the pump in a pit.

As shown in FIGS. 16 and 17, according to another aspect of the present invention, the pump 1110 may further include a first check valve 1185 secured to the first cavity fluid outlet port 1173 for permitting the flow of fluid from the first cavity portion 1181 and for prohibiting the flow of fluid into the first cavity portion 1181.

According to another aspect of the present invention, the pump 1110 may further include a second check valve 1186 secured to the second cavity fluid outlet port 1177 for permitting the flow of fluid from the second cavity portion 1183 and for prohibiting the flow of fluid into the second cavity portion 1183.

As shown in FIGS. 16 and 17, water may enter the pump through first cavity inlet fluid port 1171 and be directed radially outward by first impeller 1114 to first cavity portion 1181. From first cavity portion 1181 the water may progress to first cavity fluid outlet port 1173 and through first check valve 1185 and out outlet pipe or conduit 1192 and eventually out of the building 1104.

Figure 14:
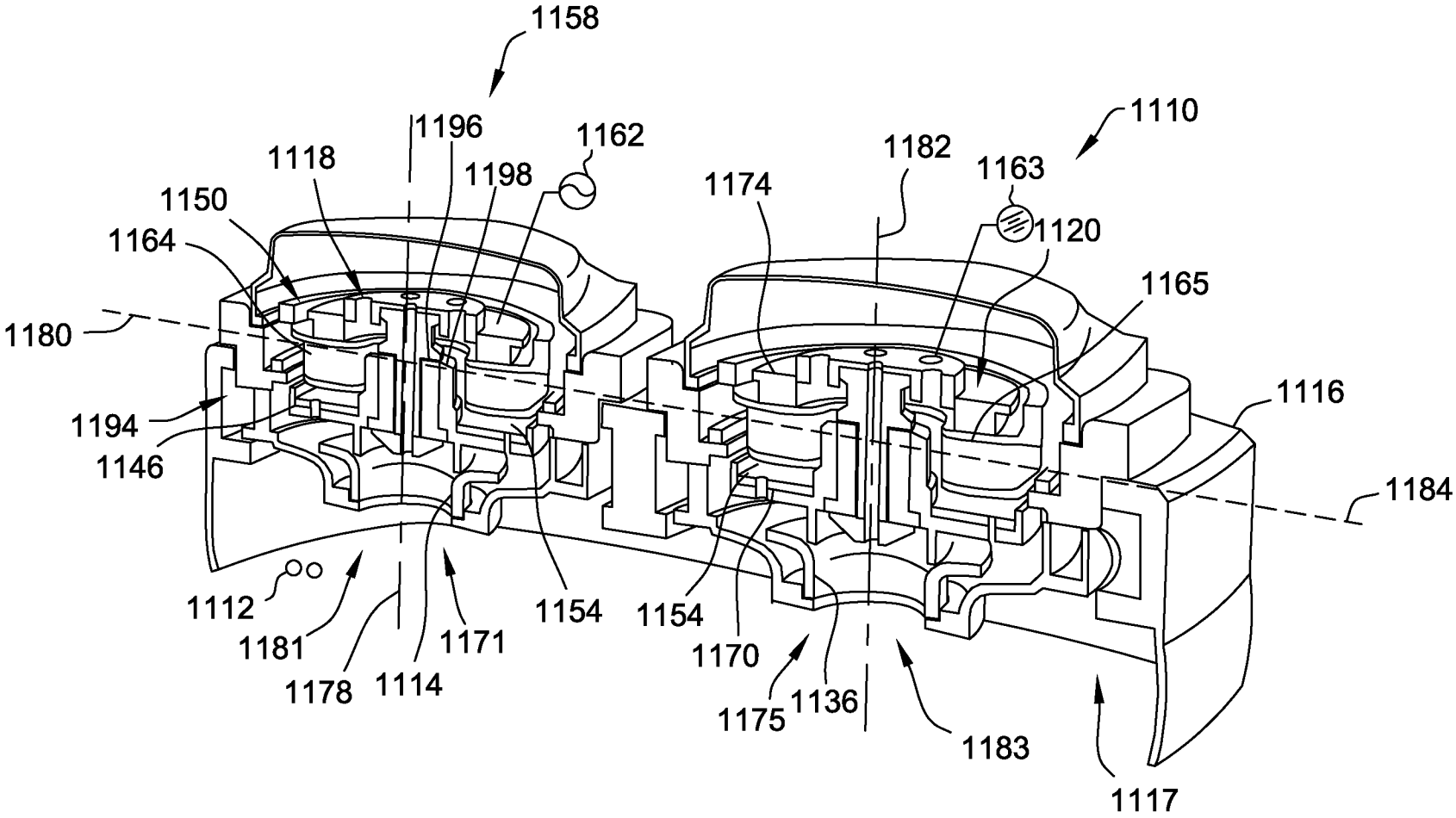
FIG. 14 is a plan view, partially in cross section of another embodiment of the present invention in the form of a pump having two axial motors, each driving a separate impeller, and spaced side by side in a common housing with two inlets and a common outlet.

As shown in FIG. 14, the pump 1110 may be configured to have water exiting the impeller to fill the entire first cavity portion 1181 or, as shown, the first cavity portion 1181 may have a barrier or divider 1194 positioned above the impeller 1114 to isolate the stators 1150 and 1174 from the water.

According to another aspect of the present invention, the pump 1110 may be configured such that the first motor stator 1150 or such that the second motor stator 1174 is encapsulated in oil.

According to another aspect of the present invention, the pump 1110 may be configured such that the first motor stator 1150 or such that the second motor stator 1174 is encapsulated in a polymer.

According to another aspect of the present invention, the pump 1110 may be configured such that the first motor stator 1150 or such that the second motor stator 1174 is water cooled.

According to another aspect of the present invention, the pump 1110 may be configured such that the first impeller 1114 is supported by water bearings 1158. One set of water bearings (sleeve bearings) 1158 is positioned on the lower side of the pump 1110 between the housing 1116 and the first impeller 1114. The other set of water bearings 1158 is formed with inner sleeve 1196 connected to first impeller 1114 and outer sleeve 1198 connected to first stator 1150.

According to another aspect of the present invention, the pump 1110 may be configured such that the first cavity fluid inlet port 1171 is concentric with the rotational centerline 1178 of the first axial flux motor 1118 and such that second cavity fluid inlet port 1175 is concentric with the rotational centerline 1082 of the second axial flux motor 1120.

Referring again to FIG. 16 and according to another aspect of the present invention, the housing outlet ports 1173 and 1177 may be normal to and spaced from the first cavity fluid inlet port 1171 and with the second cavity fluid inlet port 1175.

Figure 15:
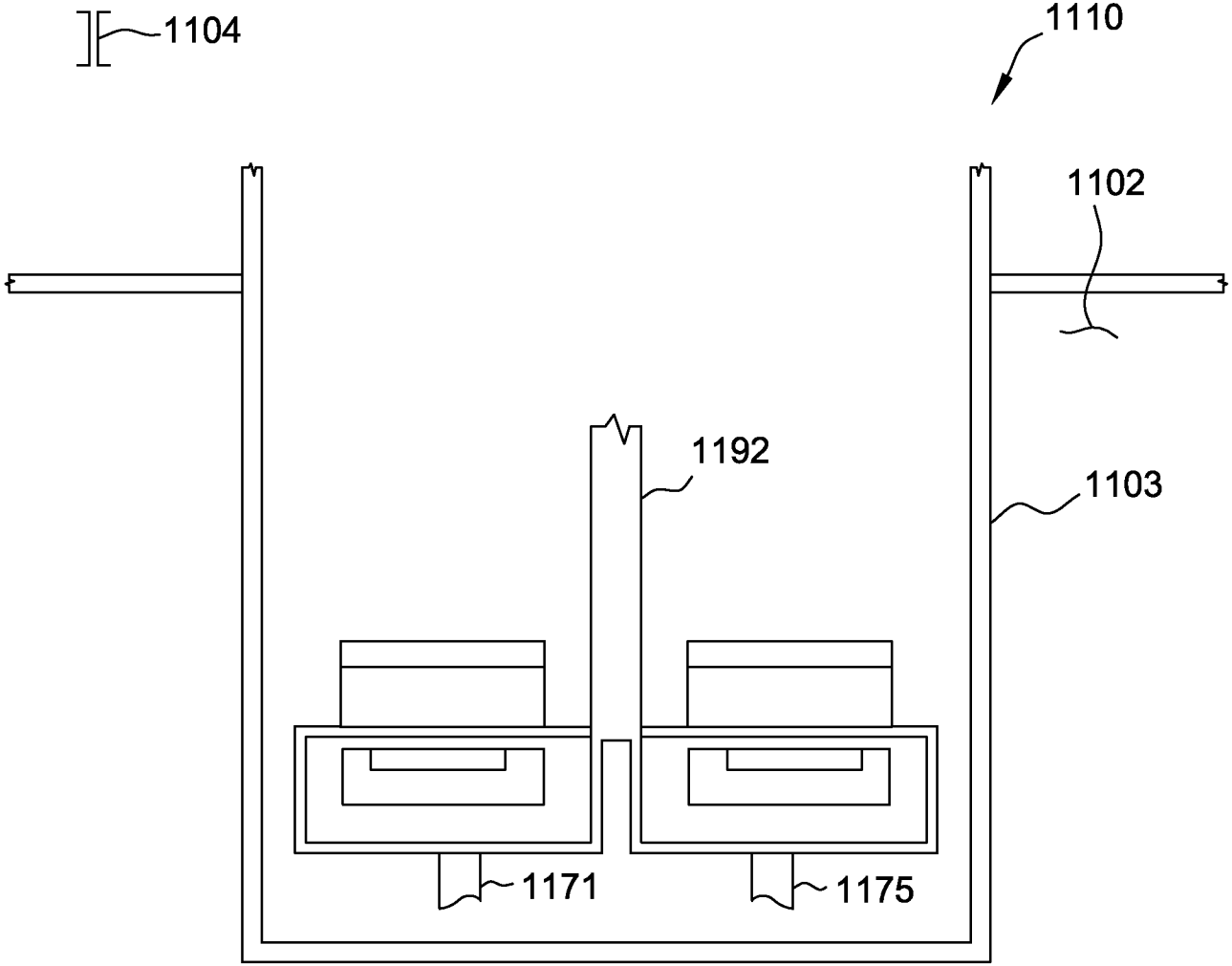
FIG. 15 is a plan view, partially in cross section of the pump of FIG. 15 showing the inlets and outlet in greater detail.

As shown in FIG. 15, the pump 1110 may be positioned in pit 1103 and provide for intake of water at the inlet ports 1171 and 1175 and provide for the exit of water from the pit 1103 through outlet pipe 1192.

Power is supplied from a power source 1162 to energized coils 1164 positioned in the first stator 1150. The coils 1164 in the stator 1150 cooperate with the magnets 1154 in the rotor 1146 to rotate the rotor 1146 and the impeller 1114.

Power is supplied from a second power source 1163 to energized coils 1165 positioned in the second motor stator 1174. The coils 1165 in the stator 1174 cooperate with the magnets 1154 in the second motor rotor 1170 to rotate the second rotor 1170 and the second impeller 1136.

Note that the use of a first power source 1162 and a second power source 1163 provides for redundancy and provides for a more robust system for removing water from a basement. If the first motor 1118 fails or there is a disruption in the first power source 1162 circuit, the second motor 1120 may still be powered by the second power source 1163 and continue to remove water from the pit 1103.

Further, if the second motor 1120 fails or there is a disruption in the second power source 1163 circuit, the first motor 1118 may still be powered by the first power source 1162 and continue to remove water from the pit 1103.

Further, note that the first power source 1162 may be household alternating current and the second power source 1163 may direct current from a battery or alternating or direct current from a generator.

Figure 18:
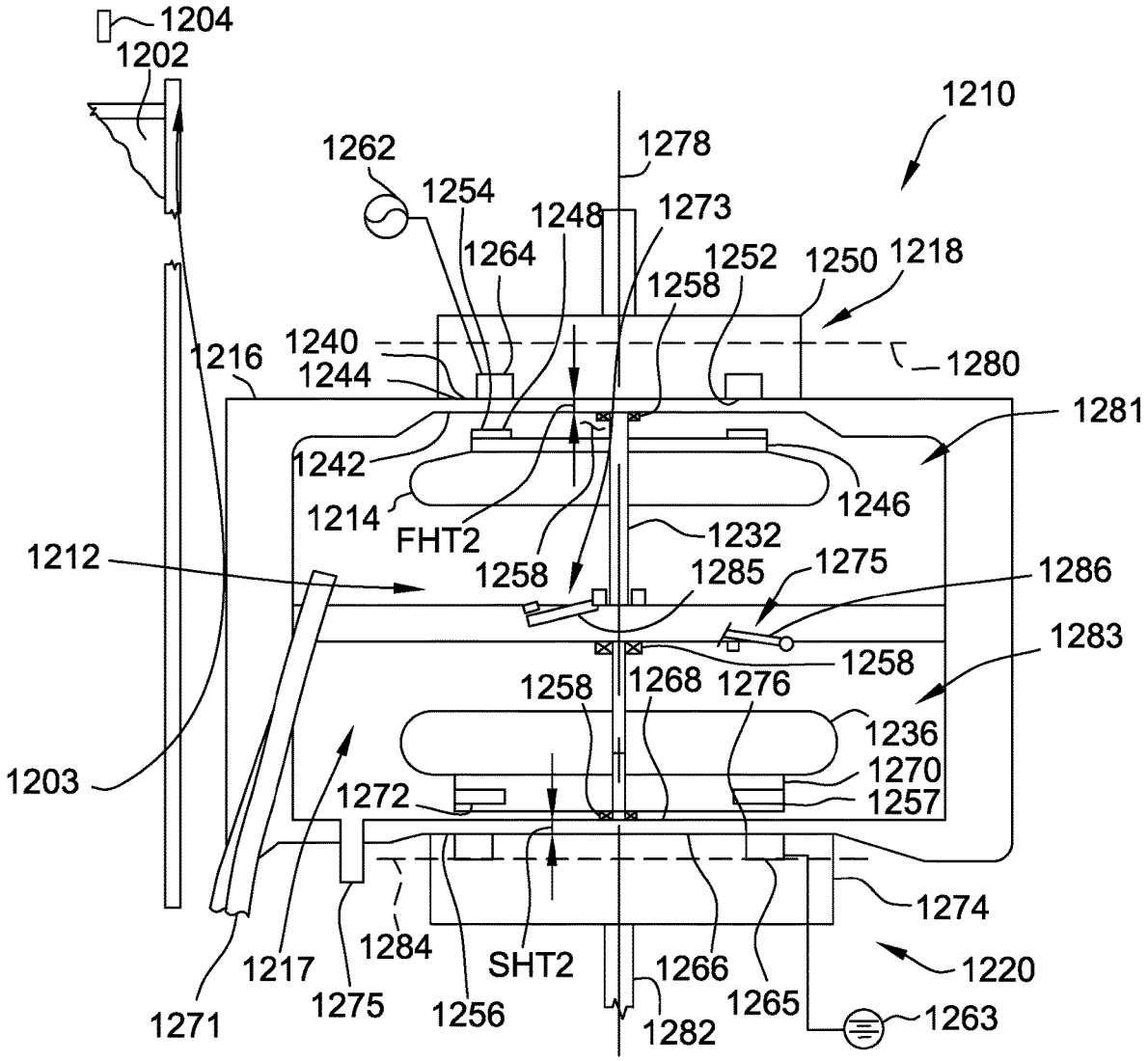
FIG. 18 is a plan view, partially in cross section of another embodiment of the present invention in the form of a pump having two axial flux motors stacked upon each other with each axial flux motor having a plate between the rotor and stator of an axial flux pump motor to permit the rotor and the impeller of each motor to have an internal shaft without a shaft seal.

According to another aspect of the present invention and referring now to FIG. 18, a pump 1210 for removing fluid 1212 collected from the subterranean surface 1202 adjacent a building 1204 is provided. The pump 1210 may include a housing 1216 defining a cavity 1217 therein and a first motor impeller 1214 rotatably secured to the housing 1216 and positioned within the cavity 1217.

According to another aspect of the present invention, the pump 1210 may further include a first axial flux motor 1218 having a rotational centerline 1278 and a traverse centerline 1280 normal to the rotational centerline. The first axial flux motor 1218 may be connected to the first motor impeller 1214 and at least partially positioned within the housing 1216.

According to another aspect of the present invention, the pump 1210 may be configured such that the first axial flux motor 1218 includes a first motor rotor 1246 fixedly secured to the first motor impeller 1214 and a first motor stator 1250 fixedly secured to the housing 1216.

According to another aspect of the present invention, the pump 1210 may further include a second motor impeller 1236 rotatably secured to the housing 1216 and positioned within the cavity 1217 and a second axial flux motor 1220 having a rotational centerline 1282 and a traverse centerline 1284 normal to the rotational centerline.

According to another aspect of the present invention, the pump 1210 may be configured such that the second axial flux motor 1220 is connected to the second motor impeller 1250 and at least partially positioned within the housing 1216. The rotational centerline 1278 of the first axial flux motor 1218 and the rotational centerline 1282 of the second axial flux motor 1220 may be being coincident. In other words, and as is shown in FIG. 18, the second axial flux motor 1220 is positioned directly above the first axial flux motor 1218.

According to another aspect of the present invention, the second axial flux motor 1220 may include a second motor rotor 1270 fixedly secured to the second motor impeller 1236 and a second motor stator 1274 fixedly secured to the housing 1216.

According to another aspect of the present invention, the pump 1210 may be configured such that the housing 1216 defines a first cavity portion 1281 within the cavity 1217 for receiving the first motor impeller 1214. The housing 1216 may define a first cavity fluid inlet port 1271 and a first cavity fluid outlet port 1273.

According to another aspect of the present invention, the pump 1210 may be configured such that the housing 1216 defines a second cavity portion 1283 within the cavity 1217 for receiving the second motor impeller 1236. The housing 1216 may define a second cavity fluid inlet port 1275 and a second cavity fluid outlet port 1277.

According to another aspect of the present invention, the pump 1210 may further include a first check valve 1285 secured to the first cavity fluid outlet port 1271 for permitting the flow of fluid from the first cavity portion 1281 and for prohibiting the flow of fluid into the first cavity portion 1281. The pump 1210 may further include a second check valve 1286 secured to the second cavity fluid outlet port 1275 for permitting the flow of fluid from the second cavity portion 1283 and for prohibiting the flow of fluid into the second cavity portion 1283.

According to another aspect of the present invention, the pump 1210 may be configured such that the housing 1216 includes a first portion 1240 thereof defining opposed parallel spaced apart internal and exterior generally planar surfaces 1242 and 1244 having a first thin cross-sectional thickness FHT2.

According to another aspect of the present invention, the pump 1210 may be configured such that the first rotor 1246 has a generally planar surface 1248 thereof positioned adjacent to and parallel to the internal generally planar surface 1242 of the first portion 1240 of the housing 1216 and wherein the first stator 1250 has a generally planar surface 1252 thereof positioned on the external generally planar surface 1244 of the first portion 1240 of the housing 1216.

According to an aspect of the invention and continuing to refer to FIG. 18, a second portion 1256 of the housing 1216 has opposed parallel inner and outer surfaces 1266 and 1268, respectively. The second portion 1256 is positioned between the generally planar surface 1276 of the second motor stator 1274 and the generally planar surface 1272 of the second rotor 1270. The second portion 1256 has a second thin cross-sectional thickness SHT2 that is made as thin as possible to provide a housing of sufficient strength to support the second rotor 1270, the second stator 1274 and the second impeller 1236. For example, the second thin cross-sectional thickness SHT2 may be 0.005 to 0.180 inches.

The first portion 1240 of the housing 1216 is preferably made of a material that has proper electrical conductivity and proper magnet conductivity to permit the first rotor 1246 and the first stator 1250 to be on opposite sides of the first portion 1240 and still convey the magnetic forces necessary to permit the first motor 1218 to rotate with sufficient force and velocity to move a sufficient quantity of fluid 1212 through the impeller 1214. The first portion 1240 of the housing 1216 may be made of for example, stainless steel or other material with similar magnetic and electrical properties.

The first rotor 1246 may have may have any suitable shape and may be made of any suitable materials. The first rotor 1246 may include a plurality of spaced apart magnets 1254. The magnets may extend axially from one face of the rotor and the distal end of the magnets 1254 may define the generally planar surface 1248 of the rotor. The magnets 1254 may be permanent magnets 1254. For example, the magnets 1254 may be rare earth magnets, for example, neodymium magnets. The rotor 1246 may be rotatably secured to the housing by a first motor shaft 1232 mounted to the housing 1216 by bearings 1258 rotatably secured to shaft and fixedly secured to housing. It should be appreciated that the first motor shaft 1232 may be supported internally within the housing 1216 eliminating any need for shaft seals in the housing.

Power is supplied from a power source 1262 to energized coils 1264 positioned in the first stator 1250. The coils 1264 in the stator 1250 cooperate with the magnets 1254 in the rotor 1246 to rotate the rotor and the impeller 1214.

Power is supplied from a second power source 1263 to energized coils 1265 positioned in the second motor stator 1274. The coils 1265 in the stator 1274 cooperate with the magnets 1254 in the second motor rotor 1270 to rotate the second rotor 1270 and the second impeller 1236.

Note that the use of a first power source 1262 and a second power source 1263 provides for redundancy and provides for a more robust system for removing water from a basement. If the first motor 1218 fails or there is a disruption in the first power source 1262 circuit, the second motor 1220 may still be powered by the second power source 1263 and continue to remove water from the pit 1203.

Further, if the second motor 1220 fails or there is a disruption in the second power source 1263 circuit, the first motor 1218 may still be powered by the first power source 1262 and continue to remove water from the pit 1203.

Figure 19:
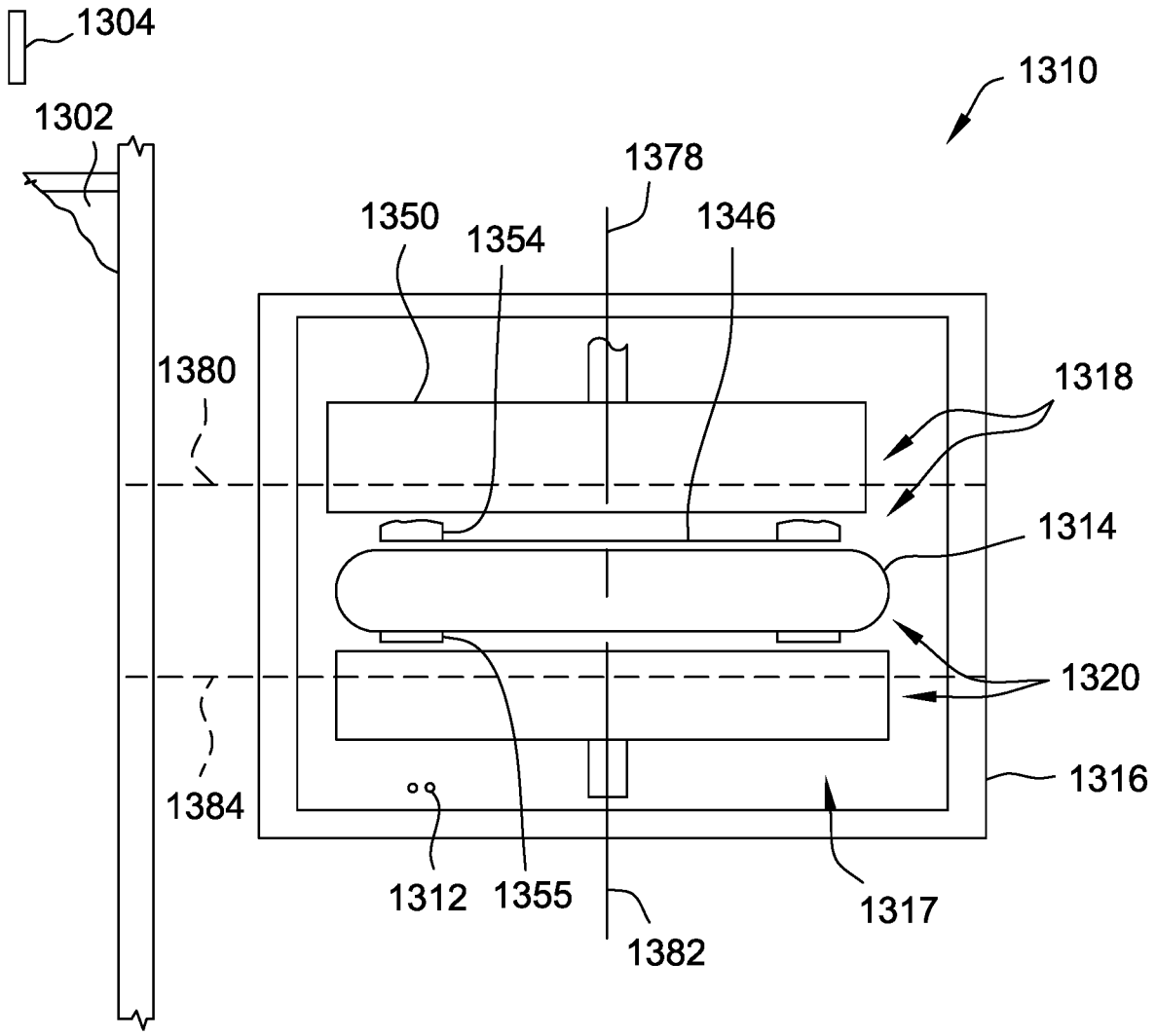
FIG. 19 is a plan view, partially in cross section of another embodiment of the present invention in the form of a pump having a common rotor and two stators.

According to another aspect of the present invention and referring now to FIG. 19, a pump 1310 for removing fluid 1312 collected from the subterranean surface 1302 adjacent a building 1304 is provided. The pump 1310 may include a housing 1316 defining a cavity 1317 therein and a first motor impeller 1314 rotatably secured to the housing 1316 and positioned within the cavity 1317.

According to another aspect of the present invention, the pump 1310 may further include a first axial flux motor 1318 having a rotational centerline 1378 and a traverse centerline 1380 normal to the rotational centerline. The first axial flux motor 1318 may be connected to the first motor impeller 1314 and at least partially positioned within the housing 1316.

According to another aspect of the present invention, the pump 1310 may be configured such that the first axial flux motor 1318 includes a first motor rotor 1346 fixedly secured to the first motor impeller 1314 and a first motor stator 1350 fixedly secured to the housing 1316.

According to another aspect of the present invention, the pump 1310 may further include a second axial flux motor 1320 having a rotational centerline 1382 and a traverse centerline 1384 normal to the rotational centerline. Unlike pump 1210 of FIG. 18, pump 1310 utilizes a common first impeller 1314 to be driven by both the first motor 1318 and the second motor 1320.

According to another aspect of the present invention, the pump 1310 may be configured such that the second axial flux motor 1320 is connected to the first motor impeller 1314 and at least partially positioned within the housing 1316. The rotational centerline 1378 of the first axial flux motor 1318 and the rotational centerline 1382 of the second axial flux motor 1320 may be being coincident.

According to another aspect of the present invention and unlike pump 1210 of FIG. 18, pump 1310 utilizes a common first motor rotor 1346 fixedly secured to the first motor impeller 1314 and a second motor stator 1374 fixedly secured to the housing 1316. The first motor rotor 1346 and the second motor stator 1374 form the second motor 1320.

The first rotor 1346 includes a first set of magnets 1354 that cooperates with the first motor stator 1350 and a second set of magnets 1355 that cooperates with the second motor stator 1374.

Figure 20:
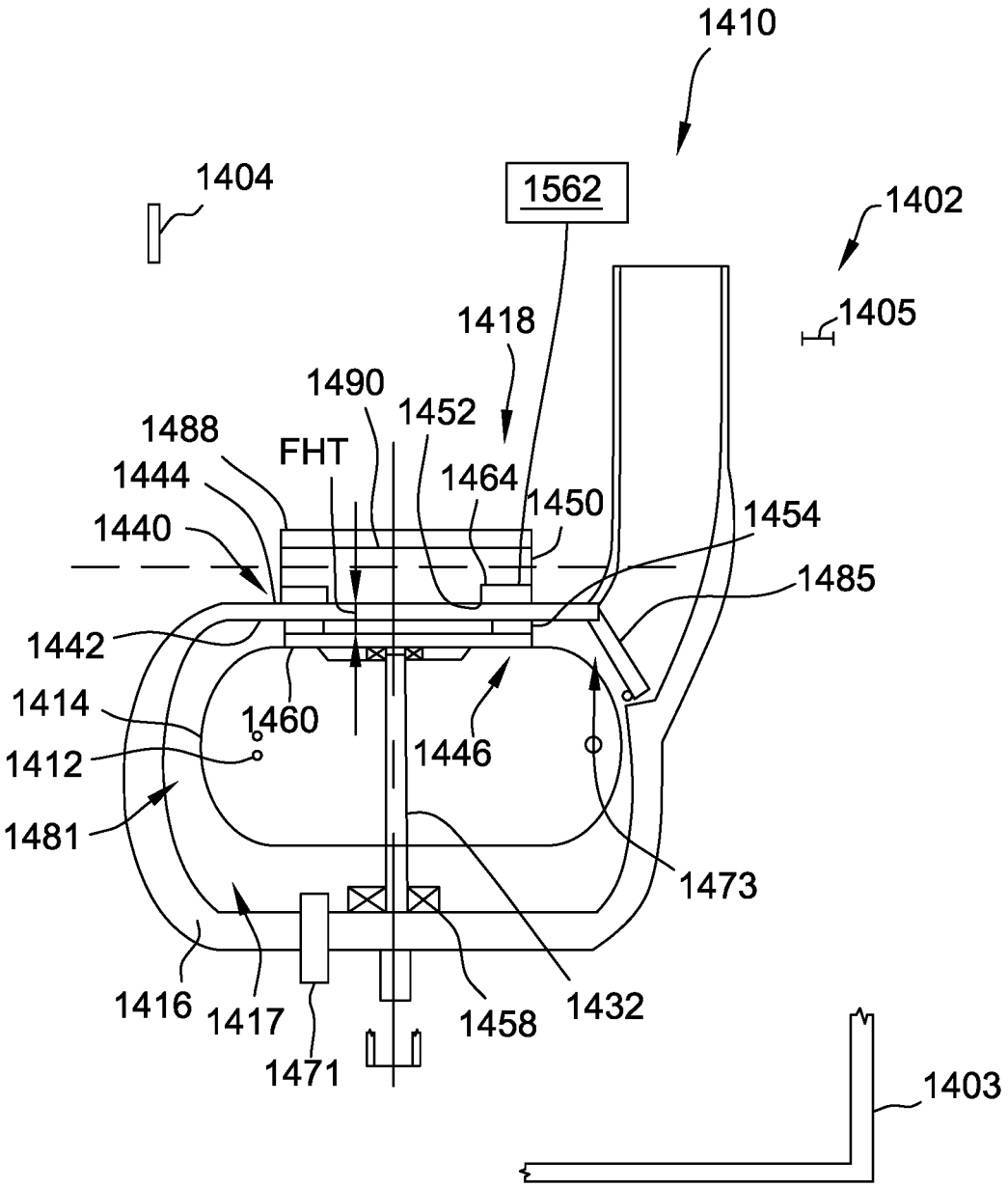
FIG. 20 is a plan view, partially in cross section of another embodiment of the present invention in the form of a pump having a plate between the rotor and stator of the motor to permit the rotor and the impeller of the motor to have an internal shaft without a shaft seal.

Referring now to FIG. 20, another aspect of the present invention is shown as a pump for removing water in a sump pump. The pump 1410 includes a housing 1416 defining a cavity 1417 therein. The housing 1416 includes a portion 1440 thereof defining opposed parallel spaced apart internal and exterior generally planar surfaces 1442 and 1444, respectively. The pump 1410 also includes an impeller 1414 rotatably secured to the housing 1416 and positioned within the housing 1416. The pump 1410 also includes an axial flux motor 1418 connected to the impeller 1414 and at least partially positioned within the housing 1416.

The axial flux motor 1418 includes a motor rotor 1446 fixedly secured to the impeller 1414. The motor rotor 1446 has a generally planar surface 1448 thereof positioned adjacent to and parallel to the internal generally planar surface 1442 of the portion 1440 of the housing 1416. The axial flux motor 1418 includes a motor stator 1450 fixedly secured to the housing 1416. The motor stator 1450 has a generally planar surface 1452 thereof positioned adjacent to and parallel to the external generally planar surface 1444 of the portion 1440 of the housing 1416.

Figure 20A:
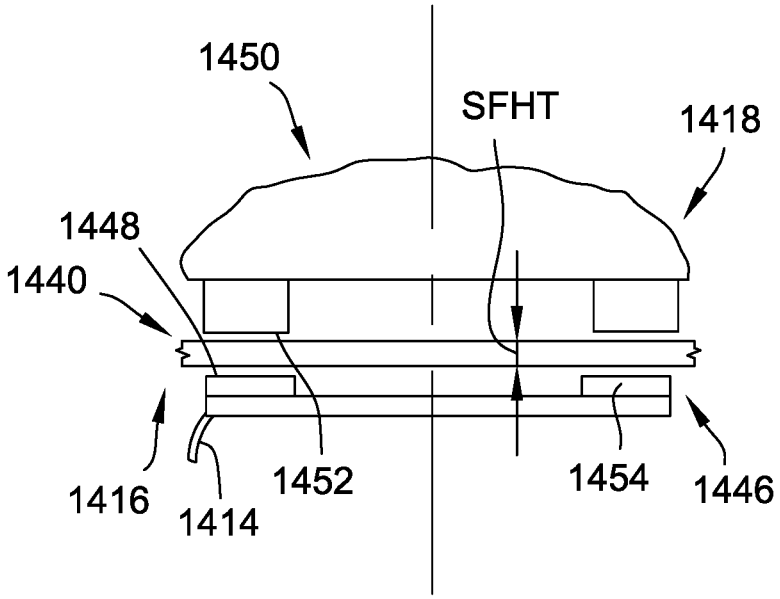
FIG. 20A is a partial plan view, partially in cross section of FIG. 20, showing the plate in greater detail.

According to an aspect of the invention and referring now to FIG. 20A, the portion 1440 of the housing 1416 positioned between the generally planar surface 1452 of the stator 1450 and the generally planar surface 1448 of the rotor 1446 has a first thin cross sectional thickness SFHT that is made as thin as possible to provide a housing of sufficient strength to support the first rotor 1446, the first stator 1450 and the impeller 1414. For example, the first thin cross-sectional thickness SFHT may be 0.005 to 0.180 inches.

The portion 1440 of the housing 1416 is preferably made of a material that has proper electrical conductivity and proper magnet conductivity to permit the rotor 1446 and the stator 1450 to be on opposite sides of the portion 1440 and still convey the magnetic forces necessary to permit the motor 1418 to rotate with sufficient force and velocity to move a sufficient quantity of fluid 1412 through the impeller 1414. The portion 1440 of the housing 1416 may be made of, for example, stainless steel or other material with similar magnetic and electrical properties.

The rotor 1446 may have may have any suitable shape and may be made of any suitable materials. The rotor 1446 may include a plurality of spaced apart magnets 1454. The magnets may extend axially from one face of the rotor 1446 and the distal end of the magnets 1454 may define the generally planar surface 1448 of the rotor 1446. The magnets 1454 may be permanent magnets 1454. For example, the magnets 1454 may be rare earth magnets, for example, neodymium magnets. The rotor 1446 may be rotatably secured to the housing by a motor shaft 1432 mounted to the housing 1416 by bearings 1458 rotatably secured to shaft and fixedly secured to housing. It should be appreciated that the motor shaft 1432 may be supported internally within the housing 1416 eliminating any need for shaft seals in the housing.

The impeller 1414 may have any suitable shape and may be made of any suitable materials. As shown in FIG. 20, the impeller 1414 is secured to lower surface 1460 of the rotor 1446. The impeller 1414 may be made of any suitable materials and may be secured to the rotor 1446 by any suitable method, such as, for example, by fasteners, welding or molding.

Power is supplied from a power source 1462 to energized coils 1464 positioned in the stator 1450. The coils 1464 in the stator 1450 cooperate with the magnets 1454 in the rotor 1446 to rotate the rotor and the impeller 1414.

According to another aspect of the present invention, the pump 1410 may be configured such that the housing 1416 defines a cavity portion 1481 within the housing cavity 1417 for receiving the motor impeller 1414. The cavity portion 1481 and the housing 1416 may define a cavity fluid inlet port 1471 and a cavity fluid outlet port 1473.

According to another aspect of the present invention, the pump 1410 may further include a check valve 1485 secured to the cavity fluid outlet port 1473 for permitting the flow of fluid from the cavity portion 1481 and for prohibiting the flow of fluid into the cavity portion 1481.

It should be appreciated that the pump 1410 may be placed in pit 1403 extending downwardly from the surface 1402 of a building 1404. The pump 1410 may be totally or partially submerged below water line 1405 of the pit 1403.

To accommodate surviving in a submerged environment, the pump 1410 may be made of materials that are resistant to rusting or other water aggravating conditions. For example, the pump 1410 may be made of polymers, composites, aluminum or stainless steel. The cavity 1417 of housing 1416 may be filled with water and the bearings 1458 may be water bearing or sleeve bearings. The flow of water through the impeller 1414 may be used to cool the bearings 1458, the impeller 1414 and the rotor 1446.

To cool the stator 1450, water may pass by the portion 1440 of the housing 1416. This water will cool the portion 1440 and the stator 1450 which is mounted to the portion 1440.

To prevent grounding of the stator 1450, the stator 1450 may be encapsulated in a polymer. Alternatively, the stator 1450 may be filled with an oil.

It should be appreciated that the pump may be configured such that the axial flux motor 1418 is an Electronically Commutated Motor (an ECM motor). If the motor 1418 is an ECM motors, the pump 1410 may further include a controller 1488 for controlling the rotational speed of the motor 1418. The controller 1488 may be positioned on top surface 1490 of the stator 1450 of motor 1418 and, as such, be positioned outside the housing 1416. The controller 1488 may be encapsulated in a polymer or may be encapsulated in an oil.

Figure 21:
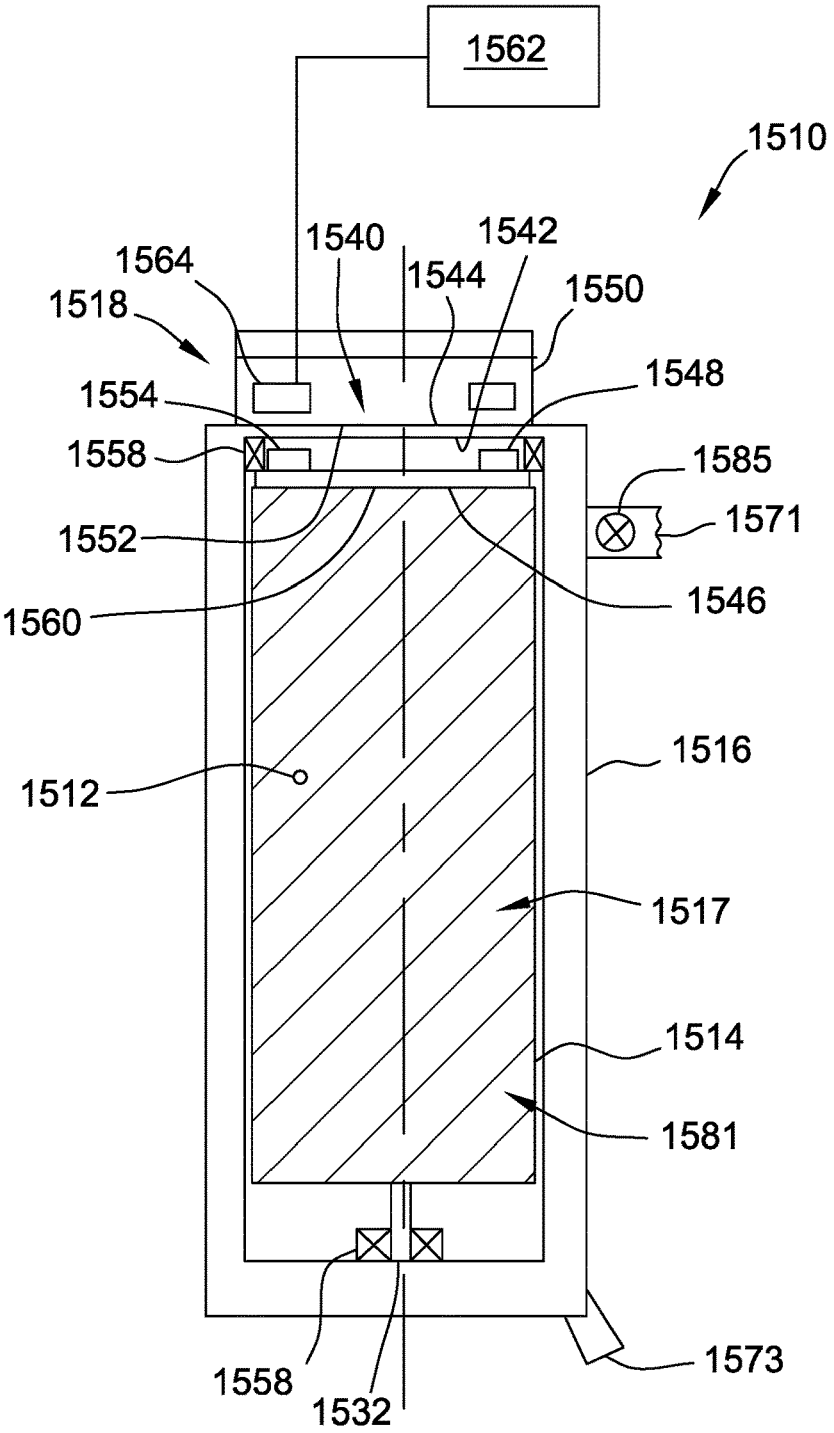
FIG. 21 is a plan view, partially in cross section of another embodiment of the present invention in the form of a compressor having a plate between the rotor and stator of the motor to permit the rotor and the scroll of the motor to have an internal shaft without a shaft seal.

Referring now to FIG. 21, another aspect of the present invention is shown as a pump for compressing a fluid, for example a refrigerant. Such a pump may be typically called a compressor 1510. The compressor 1510 includes a housing 1516 defining a cavity 1517 therein. The housing 1516 includes a portion 1540 thereof defining opposed parallel spaced apart internal and exterior generally planar surfaces 1542 and 1544, respectively. The compressor 1510 also includes a scroll 1514 rotatably secured to the housing 1516 and positioned within the housing 1516. The compressor 1510 also includes an axial flux motor 1518 connected to the scroll 1514 and at least partially positioned within the housing 1516.

The axial flux motor 1518 includes a motor rotor 1546 fixedly secured to the scroll 1514. The motor rotor 1546 has a generally planar surface 1548 thereof positioned adjacent to and parallel to the internal generally planar surface 1542 of the portion 1540 of the housing 1516. The axial flux motor 1518 includes a motor stator 1550 fixedly secured to the housing 1516. The motor stator 1550 has a generally planar surface 1552 thereof positioned adjacent to and parallel to the external generally planar surface 1544 of the portion 1540 of the housing 1516.

Figure 21A:
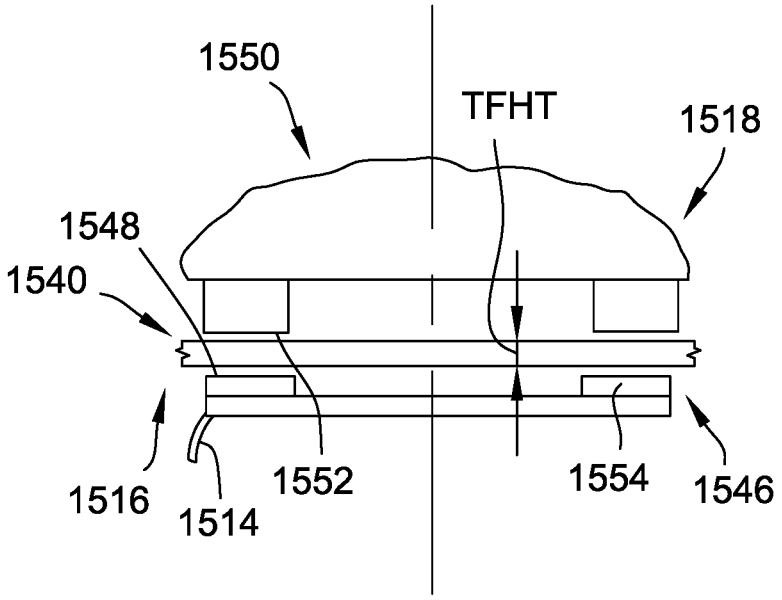
FIG. 21A is a partial plan view, partially in cross section of FIG. 21, showing the plate in greater detail.

According to an aspect of the invention and referring now to FIG. 21A, the portion 1540 of the housing 1516 positioned between the generally planar surface 1552 of the stator 1550 and the generally planar surface 1548 of the rotor 1546 has a first thin cross sectional thickness TFHT that is made as thin as possible to provide a housing of sufficient strength to support the first rotor 1546, the first stator 1550 and the scroll 1514. For example, the first thin cross-sectional thickness TFHT may be 0.005 to 0.180 inches.

The portion 1540 of the housing 1516 is preferably made of a material that has proper electrical conductivity and proper magnet conductivity to permit the rotor 1546 and the stator 1550 to be on opposite sides of the portion 1540 and still convey the magnetic forces necessary to permit the motor 1518 to rotate with sufficient force and velocity to move a sufficient quantity of fluid 1512 through the scroll 1514. The portion 1540 of the housing 1516 may be made of, for example, stainless steel or other material with similar magnetic and electrical properties.

The rotor 1546 may have may have any suitable shape and may be made of any suitable materials. The rotor 1546 may include a plurality of spaced apart magnets 1554. The magnets may extend axially from one face of the rotor 1546 and the distal end of the magnets 1554 may define the generally planar surface 1548 of the rotor 1546. The magnets 1554 may be permanent magnets 1554. For example, the magnets 1554 may be rare earth magnets, for example, neodymium magnets. The rotor 1546 may be rotatably secured to the housing by a motor shaft 1532 mounted to the housing 1516 by bearings 1558 rotatably secured to shaft and fixedly secured to housing. It should be appreciated that the motor shaft 1532 may be supported internally within the housing 1516 eliminating any need for shaft seals in the housing.

The scroll 1514 may have any suitable shape and may be made of any suitable materials. As shown in FIG. 21, the scroll 1514 is secured to lower surface 1560 of the rotor 1546. The scroll 1514 may be made of any suitable materials and may be secured to the rotor 1546 by any suitable method, such as, for example, by fasteners, welding or molding.

Power is supplied from a power source 1562 to energized coils 1564 positioned in the stator 1550. The coils 1564 in the stator 1550 cooperate with the magnets 1554 in the rotor 1546 to rotate the rotor and the scroll 1514.

According to another aspect of the present invention, the compressor 1510 may be configured such that the housing 1516 defines a cavity portion 1581 within the housing cavity 1517 for receiving the motor scroll 1514. The cavity portion 1581 and the housing 1516 may define a cavity refrigerant inlet port 1571 and a cavity refrigerant outlet port 1573.

According to another aspect of the present invention, the compressor 1510 may further include a check valve 1585 secured to the cavity refrigerant inlet port 1573 for permitting the flow of fluid into the cavity portion 1581 and for prohibiting the flow of fluid out of the cavity portion 1581.

It should be appreciated that the scroll 1514 may be placed in the housing 1516. The scroll 1514 of the compressor 1510 may be totally separated from the stator 1550 by portion 1540 of the housing 1516.

To accommodate surviving in a refrigerant environment, the compressor 1510 may be made of materials that are resistant to rusting or other refrigerant aggravating conditions. For example, the compressor 1510 may be made of polymers, composites, aluminum or stainless steel. The cavity 1517 of housing 1516 may be filled with refrigerant and the bearings 1558 may be refrigerant bearing or sleeve bearings. The flow of refrigerant through the scroll 1514 may be used to cool the bearings 1558, the scroll 1514 and the rotor 1546.

To cool the stator 1550, refrigerant may pass by the portion 1540 of the housing 1516. This refrigerant will cool the portion 1540 and the stator 1550 which is mounted to the portion 1540.

To prevent grounding of the stator 1550, the stator 1550 may be encapsulated in a polymer. Alternatively, the stator 1550 may be filled with an oil.

It should be appreciated that the pump may be configured such that the axial flux motor 1518 is an Electronically Commutated Motor (an ECM motor). If the motor 1518 is an ECM motors, the compressor 1510 may further include a controller 1588 for controlling the rotational speed of the motor 1518. The controller 1588 may be positioned on top surface 1590 of the stator 1550 of motor 1518 and, as such, be positioned outside the housing 1516. The controller 1588 may be encapsulated in a polymer or may be encapsulated in an oil.

According to aspect of the present invention a sump pumping device for pumping a fluid is provided. The pumping device includes a pump adapted for pumping the fluid and a power housing connected to the pump. The pumping device further includes a first motor operably connected to the pump and adapted to provide energy to the pump. At least a portion of the first motor is positioned within the power housing. The pumping device further includes a second motor operably connected to the pump and adapted to provide energy to the pump. At least a portion of the second motor is positioned within the power housing.

According to an aspect of the present invention, the first motor and/or the second motor may be adapted to be operably connectable to AC power, to DC power, to water pressure, to a water reservoir, to a water source, such as races, dams or tides, to batteries of various voltage, to DC solar power, to DC wind turbine power, to AC wind turbine power, to DC wind turbine power, to AC wind turbine power, and/or to AC power. It should be appreciated that the motor may be adapted to be connected to any combination of power sources listed or to any other available power source.

According to another aspect of the present invention, the first motor or the second motor may be an induction motor, a permanent magnet motor, a switched reluctance motor, an electrically commutated motor (ECM) motor or an axial flux motor. It should be appreciated that the other motor may be a motor of the same or different type.

An electronically commutated motor hereinafter referred to as an ECM motor may be a brushless alternating current motor or a brushless direct current motor. An ECM motor may include a trapezoidal drive or a sinusoidal drive.

Other motors, in addition to those which fall into the ECM description, yet have controllers, may be used for the invention herein. For example, the first motor and/or the second motor may be a switched reluctance motor or an axial flux motor having a controller. The controller may be an electronic controller. The controller may be used to commutate the motor, According to another aspect of the present invention, the first motor or the second motor may be adapted to operate at variable speeds. Such a motor operable at different speeds may be an ECM motor. It should be appreciated that the variable speeds of the motor with the variable speeds may have speeds adapted to match the incoming flow rate of the water in the pit. It should further be appreciated that the variable speeds of the motor with the variable speeds may be controlled to change the speeds of the motor to prevent water hammering.

According to another aspect of the present invention, the first motor or the second motor may be adapted to operate in a reverse direction to attempt to clear debris from one of the intake and or impeller. It should further be appreciated that the operation in the reverse direction may include a pulsing cycle to assist in clearing debris.

According to another aspect of the present invention, the sump pumping device may include a battery. It should further be appreciated that the sump pumping device may include a charging device for charging the battery. It should further be appreciated that the charging is one of desulfating, trickle charge, fast charging and deep cycle charging.

According to another aspect of the present invention, the sump pumping device may include a controller. It should further be appreciated that the sump pumping device may include means to connect AC to the controller. It should further be appreciated that the controller may be adapted to charge the battery with the AC.

According to another aspect of the present invention, the sump pumping device may include a turbine. It should further be appreciated that the turbine may be adapted to be positioned in a downspout, a pressurized water line, or a conduit connected to a water reservoir. It should further be appreciated that the turbine may be connected to a generator. It should further be appreciated that the generator may be connected to the first motor and/or the second motor.

According to another aspect of the present invention, the sump pumping device may include a controller. The controller may control the operation of the motor. It should further be appreciated that the controller may utilize DPT (direct power transfer) technology. It should further be appreciated that the controller may be adapted to establish a signature or characteristics of the operating parameters of the system at initial startup and to compare actual operating parameters with the signature at initial startup. It should further be appreciated that the signature or characteristics include a torque profile. It should further be appreciated that the controller may be adapted to monitor power used to fluid flow rate and compare that flow to incoming fluid to measure the proper operation of the overall system including at least one of check valves, pipe connections and pipe and other blockages. It should further be appreciated that the controller may be adapted to operate at higher outputs to keep up with unusually high flow demands, such as those from heavy rains. It should further be appreciated that the controller may be adapted to measure one of the torque, speed and power of the motor. It should further be appreciated that the controller may be adapted to determine a no-load condition, based on temperature and one of the torque, speed and power of the motor.

According to another aspect of the present invention, the sump pumping device may be configured such that the first motor and/or the second motor may include windings. It should further be appreciated that the sump pumping device may further include a controller. It should further be appreciated that the sump pumping device may further include a temperature sensor positioned adjacent one of the windings and the controller, the controller and the sensor adapted to monitor the temperature of one of the windings and the controller. It should further be appreciated that the controller may be adapted to utilize a temperature obtained from temperature sensor to maximize system performance.

According to another aspect of the present invention, the sump pumping device may be provided with the pump having an impeller. Further the first motor and/or the second motor may include a shaft. Further the first motor and/or the second motor may be adapted to rotate in a first direction. Further the impeller may be so secured to the shaft that it will not release from the shaft if turned in a direction opposed to the first direction.

According to another aspect of the present invention, the sump pumping device may be provided such that the first motor and/or the second motor is a variable speed motor and such that the pump and the system requirements are matched to maximize at least one of flow and efficiency.

According to another aspect of the present invention, the sump pumping device may be provided such the first motor and/or the second motor is a high-speed motor. It should further be appreciated that the high-speed motor may be adapted to operate at around 18,000 RPM or higher.

According to another aspect of the present invention, the sump pumping device may be provided with an isolator for isolating the device from power spikes and lightning strikes. It should further be appreciated that the isolator may be a battery system.

According to another aspect of the present invention, the sump pumping device may be provided such that the first motor and/or the second motor may be an ECM motor. It should be appreciated that the sump pumping device may further include a controller. It should further be appreciated that the ECM motor may be a backup motor. It should further be appreciated that the backup motor may be periodically operated. It should further be appreciated that the controller may be configured to perform diagnostics on the system, whether a primary or a backup motor.

According to another aspect of the present invention, the sump pumping device may be provided such that the first motor and/or the second motor is water cooled. It should be appreciated that the water-cooled motor may be cooled by the fluid being pumped. It should be appreciated that the water-cooled motor may include a water jacket surrounding at least a portion of the water-cooled motor. It should be appreciated that the sump pumping device may be a submersible or a semi-submersible pump.

According to another aspect of the present invention, the sump pumping device may be provided such that the first motor and/or the second motor may include a first stator and a second stator. It should be appreciated that the first stator may operate at a high voltage and the second stator may operate at a low voltage. It should be appreciated that the low voltage may be 50 volts or less. It should be appreciated that the high voltage may be 100 volts or greater According to another aspect of the present invention, the sump pumping device may be provided such that the first motor and/or the second motor include a stator having a first winding and a second winding. It should be appreciated that the first winding may operates at a high voltage. It should be appreciated that the second winding may operates at a low voltage. It should be appreciated that the sump pumping device may include a switching mechanism. It should be appreciated that the switching mechanism may be adapted to switch the first winding and/or the second winding between a first mode in which the winding operates at a high voltage and second mode in which the winding operates at a low voltage.

According to another aspect of the present invention, the sump pumping device may include a controller adapted to provide for wireless monitoring. It should be appreciated that the wireless monitoring may be from one of a computer desktop or a portable computer device. It should be appreciated that the portable computer device may be an iPhone, a tablet or an android.

According to another aspect of the present invention, the sump pumping device may be provided such that the first motor, the second motor and/or the pump is adapted for quick change.

According to another aspect of the present invention, the sump pumping device may include a housing. It should be appreciated that the pump, the first motor and/or the second motor may at least partially be positioned in the housing. It should be further appreciated that the pump, the first motor and the second motor may all be at least partially positioned in the housing.

According to another aspect of the present invention, the first motor and/or the second motor include a rotor. It should be appreciated that the pump may include an impeller. It should be appreciated that the rotor and the impeller may be juxtaposed and operably connected to each other. It should be appreciated that the rotor and the impeller may be integral to each other. It should be appreciated that the impeller and the housing substantially include the pump. It should be appreciated that the sump pumping device may include a second pump. It should be further appreciated that the first pump and the first motor may be at least partially positioned in the housing and operably associated with each other. It should be further appreciated that the second pump and the second motor may be at least partially positioned in the housing and operably associated with each other. It should be further appreciated that the sump pumping device may also include a first stator operably associated with the first motor. It should be further appreciated that the sump pumping device may also include a second stator operably associated with the second motor. It should be further appreciated that the first stator may operate at a high voltage and that the second stator may operate at a low voltage. It should be further appreciated that the sump pumping device may also include a first rotor and that the first rotor is operably associated with the first motor. It should be further appreciated that the sump pumping device may also include a second rotor that is operably associated with the second motor. It should be further appreciated that the sump pumping device may also include a first impeller operably associated with the first pump and a second impeller operably associated with the pump. It should be further appreciated that the first rotor and the second rotor may be juxtaposed and operably associated with the respective one of the first impeller and the second impeller.

According to yet another aspect of the present invention, a pumping device for pumping a fluid is shown. The pumping device includes a pump adapted for pumping the fluid and a first motor operably connected to the pump and adapted to provide energy to the pump. The pumping device also includes a second motor operably connected to the pump and adapted to provide energy to the pump.

According to yet another aspect of the present invention, a propulsion system for a pump for removing fluid collected from the subterranean surface adjacent a building. The system includes a housing operably connectable to the pump and a first motor operably connected to the pump and adapted to provide energy to the pump. At least a portion of the first motor is positioned within the power housing. The system also includes a second motor operably connected to the pump and adapted to provide energy to the pump. At least a portion of the second motor is positioned within the power housing According to another aspect of the present invention, a system for removing fluid from subterranean surface of a building is provided. The system includes a pump adapted for pumping the fluid and a first motor operably connected to the pump and adapted to provide energy to the pump. The system also includes a second motor operably connected to the pump and adapted to provide energy to the pump.

According to another aspect of the present invention, a pumping device for pumping a fluid is provided. The device includes a pump adapted for pumping the fluid and a motor. The motor has a stator and a rotor rotatably connected to the stator. The rotor and the stator are adapted to generate flux generally in a direction parallel to a rotational axis of the motor. The motor is operably connected to the pump and is adapted to provide rotational mechanical energy to the pump.

According to another aspect of the present invention, a pumping device for pumping a fluid is provided. The device includes a pump adapted for pumping the fluid and an electronically commutated motor operably connected to the pump and adapted to provide energy to the pump. The device also includes a controller operably connected to the motor and adapted to provide signals to the motor.

According to another aspect of the present invention, a motor for use with a pump for removing fluid collected from the subterranean surface adjacent a building is provided. The motor includes a housing configured for connection to the pump. The motor also includes a stator connected to the housing and a rotor rotatably connected to the stator and operably connected to the pump. The motor is adapted to provide energy to the pump. The stator has electromagnetic coils. The motor also includes a controller operably connected to the motor and adapted to provide signals to the motor to provide electronic commutation to the electromagnetic coils.

According to another aspect of the present invention, a method for removing fluid from subterranean surface of a building is provided. The method includes the steps of providing a sump, providing a discharging conduit, providing a housing, providing a pump, providing a first motor, and providing a second motor. The method also includes the step of positioning the pump. The method also includes the step of positioning the first motor and the second motor at least partially in the housing. The method also includes the step of positioning the housing at least partially in the sump and the step of connecting the pump to the discharging conduit. The method also includes the step of operably connecting the pump to the first motor and the step of operably connecting the pump to the second motor.

The methods, systems, and apparatus described herein facilitate efficient and economical assembly of an electric motor. Exemplary embodiments of methods, systems, and apparatus are described and/or illustrated herein in detail. The methods, systems, and apparatus are not limited to the specific embodiments described herein, but rather, components of each apparatus and system, as well as steps of each method, may be utilized independently and separately from other components and steps described herein. Each component, and each method step, can also be used in combination with other components and/or method steps.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Described herein are exemplary methods, systems and apparatus utilizing lower cost materials in a permanent magnet motor that reduces or eliminates the efficiency loss caused by the lower cost material. Furthermore, the exemplary methods system and apparatus achieve increased efficiency while reducing or eliminating an increase of the length of the motor. The methods, system and apparatus described herein may be used in any suitable application. However, they are particularly suited for HVAC and pump applications.

Exemplary embodiments of the fluid flow device and system are described above in detail. The electric motor and its components are not limited to the specific embodiments described herein, but rather, components of the systems may be utilized independently and separately from other components described herein. For example, the components may also be used in combination with other motor systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A pump, comprising:

a housing including a first portion thereof defining opposed parallel spaced apart internal and external planar surfaces, wherein said housing defines a first cavity portion having a first cavity fluid inlet port and a first cavity fluid outlet port;

a first check valve secured to said first cavity fluid outlet port for permitting the flow of fluid from the first cavity portion and for prohibiting the flow of fluid into the first cavity portion;

a first impeller rotatably secured to said housing and positioned within said first cavity portion;

a first axial flux motor connected to said first impeller and at least partially positioned within said first cavity portion; said first axial flux motor including;

a first motor rotor fixedly secured to said first impeller, said first motor rotor having a planar surface thereof positioned adjacent to and parallel to the internal planar surface of the first portion of said housing such that said first motor rotor is positioned within said first cavity portion; and a first motor stator fixedly secured to said housing, said first motor stator having a planar surface thereof positioned adjacent to and parallel to the external planar surface of the first portion of said housing such that said first motor stator is positioned exterior to said first cavity portion, wherein said internal and external planar surfaces of said housing extend radially inward of said first rotor and said first stator such that said internal and external planar surfaces of said housing form continuous surfaces that intersect a rotational centerline of said first axial flux motor.

2. The pump according to claim 1:

wherein said housing includes a second portion thereof defining opposed parallel spaced apart internal and external planar surfaces, further comprising a second impeller rotatably secured to said housing and positioned within said housing;

further comprising a second axial flux motor operably connected to said second impeller, at least a portion of the second axial flux motor positioned within said housing, said second axial flux motor including;

a second motor rotor fixedly secured to said second impeller, said second motor rotor having a planar surface thereof positioned adjacent to and parallel to the internal planar surface of the second portion of said housing; and a second motor stator fixedly secured to said housing, said second motor stator having a planar surface thereof positioned adjacent to and parallel to the external planar surface of the second portion of said housing.

3. The pump according to claim 2, wherein said first axial flux motor has a traverse centerline normal to the rotational centerline; and wherein said second axial flux motor has a rotational centerline and a traverse centerline normal to the rotational centerline, the traverse centerline of said first axial flux motor and the traverse centerline of said second axial flux motor being coincident.

4. The pump according to claim 2, wherein said first axial flux motor has a traverse centerline normal to the rotational centerline; and wherein said second axial flux motor has a rotational centerline and a traverse centerline normal to the rotational centerline, the rotational centerline of said first axial flux motor and the rotational centerline of said second axial flux motor being coincident.

5. The pump according to claim 2, wherein said housing defines a second cavity portion within the cavity for receiving the second impeller, the second cavity portion and said housing defining a second cavity fluid inlet port and a second cavity fluid outlet port; and further comprising a second check valve secured to said second cavity fluid outlet port for permitting the flow of fluid from the second cavity portion and for prohibiting the flow of fluid into the second cavity portion.

6. The pump according to claim 1, wherein said first motor stator is encapsulated in a polymer.

7. The pump according to claim 1:

wherein said first axial flux motor is a ECM motor; and further comprising a controller for controlling the rotational speed of said first axial flux motor.

8. A pump for removing fluid collected from the subterranean surface adjacent a building, the pump comprising:

a housing defining a cavity having a first cavity portion and a second cavity portion, wherein said first cavity portion comprises a first cavity fluid inlet port and a first cavity fluid outlet port;

a first check valve secured to said first cavity fluid outlet port for permitting the flow of fluid from the first cavity portion and for prohibiting the flow of fluid into the first cavity portion;

a first motor impeller rotatably secured to said housing and positioned within the first cavity portion;

a first axial flux motor having a rotational centerline and a traverse centerline normal to the rotational centerline, said first axial flux motor connected to said first motor impeller and at least partially positioned within said first cavity portion; said first axial flux motor including;

a first motor rotor fixedly secured to said first motor impeller and positioned within said first cavity portion adjacent and parallel to an internal planar surface of a first portion of said housing; and a first motor stator fixedly secured to an external planar surface of said first portion of said housing and positioned exterior to said first cavity portion, wherein said first portion of said housing separates said first motor rotor from said first motor stator, wherein said internal and external planar surfaces of said housing extend radially inward of said first rotor and said first stator such that said internal and external planar surfaces of said housing form continuous surfaces that intersect the rotational centerline of said first axial flux motor;

a second motor impeller rotatably secured to said housing and positioned within the cavity;

a second axial flux motor having a rotational centerline and a traverse centerline normal to the rotational centerline, said second axial flux motor connected to said second motor impeller and at least partially positioned within said housing, the traverse centerline of said first axial flux motor and the traverse centerline of said second axial flux motor being coincident; said second axial flux motor including;

a second motor rotor fixedly secured to said second motor impeller; and a second motor stator fixedly secured to said housing.

9. The pump according to claim 8: wherein said second cavity portion receives the second motor impeller, the second cavity portion and said housing defining a second cavity fluid inlet port and a second cavity fluid outlet port; and further comprising a second check valve secured to said second cavity fluid outlet port for permitting the flow of fluid from the second cavity portion and for prohibiting the flow of fluid into the second cavity portion.

10. The pump according to claim 8: wherein said first rotor has a planar surface thereof positioned adjacent to and parallel to the internal planar surface of the first portion of said housing; and wherein said first stator has a planar surface thereof positioned on the external planar surface of the first portion of said housing.

11. The pump according to claim 10: said second portion defining opposed parallel spaced apart internal and exterior planar surfaces; wherein said second motor rotor has a planar surface thereof positioned adjacent to and parallel to the internal planar surface of the second portion of said housing; and wherein said second motor stator has a planar surface thereof positioned on the external planar surface of the second portion of said housing.

12. The pump according to claim 8, wherein said first motor stator is encapsulated in oil.

13. The pump according to claim 8, wherein said first motor stator is water cooled.

14. The pump according to claim 8, wherein said first motor impeller is supported by water bearings.

15. The pump according to claim 8: wherein said second cavity portion receives the second motor impeller, the second cavity portion and said housing defining a second cavity fluid inlet port and a second cavity fluid outlet port; wherein said first cavity fluid inlet port is concentric with the rotational centerline of said first axial flux motor; and wherein said second cavity fluid inlet port is concentric with the rotational centerline of said second axial flux motor.

16. The pump according to claim 8: wherein said second cavity portion receives the second motor impeller, the second cavity portion and said housing defining a second cavity fluid inlet port and a second cavity fluid outlet port; and wherein said housing defines a housing outlet port, said housing outlet port being eccentric with said first cavity fluid inlet port and with said second cavity fluid inlet port.

17. The pump according to claim 1: wherein said external planar surface of said housing comprises an external surface of said housing.

18. The pump according to claim 1:

wherein said internal planar surface of said housing is in a face-to-face relationship with said planar surface of said first motor rotor.

19. The pump according to claim 1:

wherein said external planar surface of said housing is in a face-to-face relationship with said planar surface of said motor stator.

20. The pump according to claim 1:

wherein said internal and external planar surfaces of said housing extend a complete width of said first axial flux motor between said first motor rotor and said first motor stator.

* * * * *